US010947482B1

(12) United States Patent
Christakos et al.

(10) Patent No.: US 10,947,482 B1
(45) Date of Patent: Mar. 16, 2021

(54) STRUCTURED DETERGENT COMPOSITION PROVIDING ENHANCED SUSPENSION CONTROL, OPTICAL BRIGHTENING, AND WHITENING MAINTENANCE

(71) Applicant: Henkel IP & Holding GmbH, Duesseldorf (DE)

(72) Inventors: Sofia S. Christakos, Milford, CT (US); Calogero A. Distefano, Milford, CT (US); Michelle A. Piombino, West Haven, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 0 days.

(21) Appl. No.: 16/553,662

(22) Filed: Aug. 28, 2019

(51) Int. Cl.

| | |
|---|---|
| ***C11D 17/00*** | (2006.01) |
| ***C11D 3/12*** | (2006.01) |
| ***C11D 11/00*** | (2006.01) |
| ***C11D 1/94*** | (2006.01) |
| ***C11D 3/50*** | (2006.01) |
| *C11D 1/90* | (2006.01) |

(Continued)

(52) U.S. Cl.
CPC ..... *C11D 3/1286* (2013.01); *C11D 1/94* (2013.01); *C11D 3/505* (2013.01); *C11D 11/0017* (2013.01); *C11D 17/0013* (2013.01); *C11D 1/143* (2013.01); *C11D 1/146* (2013.01); *C11D 1/667* (2013.01); *C11D 1/72* (2013.01); *C11D 1/90* (2013.01)

(58) Field of Classification Search
CPC ..... C11D 17/0026; C11D 17/0013; C11D 17/0017; C11D 17/003; C11D 3/505; C11D 3/1256
See application file for complete search history.

(56) References Cited

U.S. PATENT DOCUMENTS 6,613,733 B1 * 9/2003 Barnabas ..... C11D 3/221 510/276
6,949,496 B1 * 9/2005 Boutique ..... C11D 3/2024 510/276

(Continued)

FOREIGN PATENT DOCUMENTS

EP 1957623 B1 5/2013

OTHER PUBLICATIONS

International Search Authority/KR, International Search Report, PCT/US2020/048236, dated Dec. 9, 2020, 11 pages, Daejeon, Republic of Korea.

*Primary Examiner* — John R Hardee
(74) *Attorney, Agent, or Firm* — Bojuan Deng

(57) ABSTRACT

A structured detergent composition has a yield stress point and includes a surfactant component present in an amount of from about 5 to about 50 weight percent actives, water present in a total amount of from about 40 to about 90 weight percent, and a smectite clay present in an amount of from about 0.2 to about 3 weight percent actives, each based on a total weight of the composition. The composition is formed by combining water and a smectite clay to form a mixture, applying shear to the mixture, combining the sheared mixture with an acidic surfactant, adding an acid to the combination of the sheared mixture and the acidic surfactant, then adding a base and a buffer. The method also includes the step of adding additional surfactants, wherein the combination of the acidic surfactant and the additional surfactants make up the surfactant component.

18 Claims, 8 Drawing Sheets

(51) Int. Cl.

| | |
|---|---|
| *C11D 1/14* | (2006.01) |
| *C11D 1/72* | (2006.01) |
| *C11D 1/66* | (2006.01) |

(56) References Cited

U.S. PATENT DOCUMENTS

| | | | | |
|---|---|---|---|---|
| 10,155,917 | B2 | 12/2018 | Coope-Epstein et al. | |
| 2002/0022583 | A1 | 2/2002 | Buzzaccarini et al. | |
| 2006/0089294 | A1 | 4/2006 | Depoot et al. | |
| 2011/0065625 | A1* | 3/2011 | Boutique | C11D 3/2093 510/336 |
| 2013/0029895 | A1* | 1/2013 | Bettiol | C11D 3/37 510/236 |
| 2015/0203799 | A1 | 7/2015 | Bettiol et al. | |

* cited by examiner

STRUCTURED DETERGENT COMPOSITION PROVIDING ENHANCED SUSPENSION CONTROL, OPTICAL BRIGHTENING, AND WHITENING MAINTENANCE

FIELD OF THE INVENTION

The present disclosure generally relates to a structured detergent composition. More specifically, this disclosure related to a structured detergent composition that includes a smectite clay which unexpectedly provides enhanced suspension control, optical brightening, and whitening maintenance.

BACKGROUND OF THE INVENTION

Currently, the commercial market lacks a structured liquid laundry detergent composition that efficiently suspends active ingredients, especially encapsulated active ingredients, such as fragrances. As just one example, encapsulated fragrances are advantageous as compared to traditional neat oil fragrances because they can provide over 12 weeks of long lasting scent on laundered fabrics. Other encapsulated active ingredients are also advantageous because encapsulation reduces premature degradation, release, and reaction with other compounds.

However, it can be difficult to formulate a structured liquid laundry detergent because most of the ingredients used to form such detergents require high shear mixing to create a desired suspension network. The level of shear required can be difficult to achieve on a commercial scale and often leads to air entrapment, which then leads to separation or settling of components. Moreover, this process typically requires a large capital investment. Some ingredients are easier to suspend in detergents but tend to hamper wash performance and can lead to anti-redeposition problems. Moreover, some ingredients are simply not stable in typical liquid detergent compositions and can react with water and/or other compounds present.

It can also be difficult to formulate a structured liquid laundry detergent composition that includes suspended compounds due to gravitational separation. Due to the differences in density between various compounds, suspended compounds tend to cream or sediment over time.

Accordingly, there remains an opportunity to develop an improved structured liquid laundry detergent composition. Furthermore, other desirable features and characteristics of the present disclosure will become apparent from the subsequent detailed description of the disclosure and the appended claims, taken in conjunction with the accompanying drawings and this background of the disclosure.

BRIEF SUMMARY OF THE INVENTION

This disclosure provides a structured detergent composition that has a yield stress point. The structured detergent composition includes a surfactant component present in an amount of from about 5 to about 50 weight percent actives based on a total weight of the composition, water present in a total amount of from about 40 to about 90 weight percent based on a total weight of the composition, and a smectite clay present in an amount of from about 0.2 to about 3 weight percent actives based on a total weight of the composition.

This disclosure also provides a method of forming the structured detergent composition. The method includes the steps of combining water and a smectite clay to form a mixture, applying shear to the mixture, combining the sheared mixture with an acidic surfactant, subsequently adding an acid to the combination of the sheared mixture and the acidic surfactant, and then adding a base and a buffer to the combination of the sheared mixture, the acidic surfactant, and the acid. The method also includes the step of adding additional surfactants. wherein the combination of the acidic surfactant and the additional surfactants comprise the aforementioned surfactant component.

This disclosure further provides a method of improving optical brightness and whitening maintenance of a textile using the structured detergent composition. The method includes the steps of providing the aforementioned structured detergent composition, applying the structured detergent composition to the textile, and washing the textile with the structured detergent composition such that the textile exhibits an optical brightness of greater than 70 delta ganz measured after five washes and exhibits a whitening maintenance of greater than 97 delta ganz measured after five washes.

The detergent composition exhibits superior and unexpected results. More specifically, the smectite clay surprisingly provides enhanced suspension control, e.g. to suspend an active agent, which itself may or may not be encapsulated. The smectite clay also surprisingly provides enhanced optical brightening of the textile even without the presence of an active agent. Moreover, the smectite clay surprisingly provides enhanced whitening maintenance of the textile, also referred to as anti-redeposition, again even without the presence of an active agent. Moreover, the smectite clay provides these unexpected enhancements without a negative effect on stain removal performance. These benefits allow for the detergent composition to be used with or without active agents but also allows a wide variety of active agents to be efficiently suspended with minimized negative interactions.

Without wishing to be bound by theory, it is believed that the smectite clay hydrates and forms a strong colloidal structure thereby providing a desired viscosity and yield stress point. However, it has been surprisingly discovered that the method used to form the structured detergent composition can affect the efficiency of the colloidal structure and suspension of active ingredients. Moreover, by incorporating the smectite clay, the structured detergent composition typically shows a trend of changing behavior from Newtonian to non-Newtonian which is beneficial for structuring and for optional suspension of the active agents.

BRIEF DESCRIPTION OF THE DRAWINGS

The present disclosure will hereinafter be described in conjunction with the following drawing figures, wherein.

DETAILED DESCRIPTION OF THE INVENTION

Figure 1:
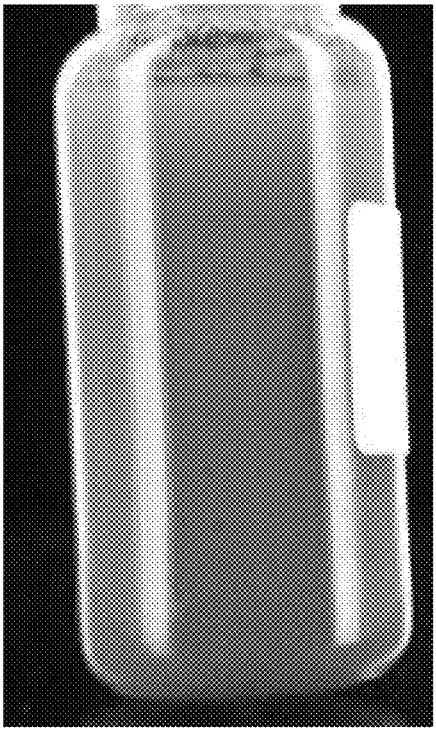
FIG. 1 is a photograph of a sample of a first version of Inventive Composition 1 after standing at room temperature overnight. This sample exhibits product separation and visible particles of smectite clay disposed throughout the sample. This is due to use of a prior art method of forming the composition.

The following detailed description is merely exemplary in nature and is not intended to limit the detergent composition. Furthermore, there is no intention to be bound by any theory presented in the preceding background or the following detailed description.

Embodiments of the present disclosure are generally directed to structured detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a structured detergent composition that exhibits surprisingly and unexpectedly enhanced suspension control, optical brightening, and whitening maintenance. The structured detergent composition may include a surfactant component, water, and a smectite clay, as described in detail below. Of these components, the smectite clay is thought to be responsible for structuring the detergent composition and for the enhanced suspension control, optical brightening, and whitening maintenance. More specifically, the enhanced suspension control allows for suspension of an active agent which itself may or may not be encapsulated. Notably, the smectite clay can provide for structuring the detergent composition and for the enhanced suspension control, optical brightening, and whitening maintenance without the presence of any active agent whatsoever, if so desired.

In another aspect, the present disclosure provides a method for forming the structured detergent composition. The method includes the steps of combining water and a smectite clay to form a mixture, applying shear to the mixture, combining the sheared mixture with an acidic surfactant, subsequently adding an acid to the combination of the sheared mixture and the acidic surfactant, and then adding a base and a buffer to the combination of the sheared mixture, the acidic surfactant, and the acid. The method also includes the step of adding additional surfactants, wherein the combination of the acidic surfactant and the additional surfactants comprise a surfactant component. In other words, the combination of the acidic surfactant and the additional surfactants is the surfactant component.

It was unexpectedly discovered that the use of shear with the mixture and the particular order of addition of the acidic surfactant followed by additional of the acid, then the base, and then the buffer, produces an unexpectedly stable structured detergent composition. To the contrary, omission of shear and/or changing the order of addition tends to form unstable compositions that tend to separate and/or flocculate, thereby rendering them unusable.

This disclosure further provides a method of improving optical brightness and whitening maintenance using the structured detergent composition. The method includes the steps of providing the aforementioned structured detergent composition, applying the structured detergent composition to a textile, and washing the textile with the structured detergent composition such that the textile exhibits an optical brightness of greater than 70 delta ganz measured after five washes and exhibits a whitening maintenance of greater than 97 delta ganz measured after five washes. As first introduced above, these results can be achieved without any active agent whatsoever, if so desired.

It was also unexpectedly discovered that, as a result of incorporating the smectite clay, the detergent composition tends to show a trend of changing the behavior of the detergent composition, from Newtonian to non-Newtonian, which is beneficial for structuring. A Newtonian fluid is a fluid wherein the ratio between shear stress changes linearly in proportion to the stress to which it is exposed. This proportion is known as viscosity. A Newtonian fluid exhibits a consistent viscosity level. More specifically, Newtonian fluids also typically exhibit a commensurate, linear increase in shear stress with increases in shear rate, while non-Newtonian fluids exhibit a non-linear relationship between shear stress and shear rate. Various non-Newtonian fluids can exhibit shear thickening (i.e., an increase in viscosity with increased shear rates) or shear thinning (i.e., a decrease in viscosity with increased shear rate). Non-Newtonian fluids that exhibit shear thinning may have a yield point. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress.

It was also unexpectedly discovered that incorporation of the smectite clay in the detergent composition allows the composition to have a thixotropic viscosity which allows for effective incorporation of a wide variety of additives.

The smectite clay provides all of these unexpected enhancements without a negative effect on stain removal performance. These beneficial properties allow for a wide variety of active agents to be suspended in the composition with minimized negative interaction with other components. Without wishing to be bound by theory, it is believed that the smectite clay hydrates and forms a strong colloidal structure thereby providing a desired viscosity and yield stress point. However, it has been surprisingly discovered that the method used to form the structured detergent composition can also affect the efficiency of the colloidal structure and suspension of active ingredients. Moreover, by incorporating the smectite clay, the structured detergent composition tends to show a trend of changing behavior from Newtonian to non-Newtonian which is beneficial for structuring and for optional suspension of the active agents.

Structured Detergent Composition

Figure 5:
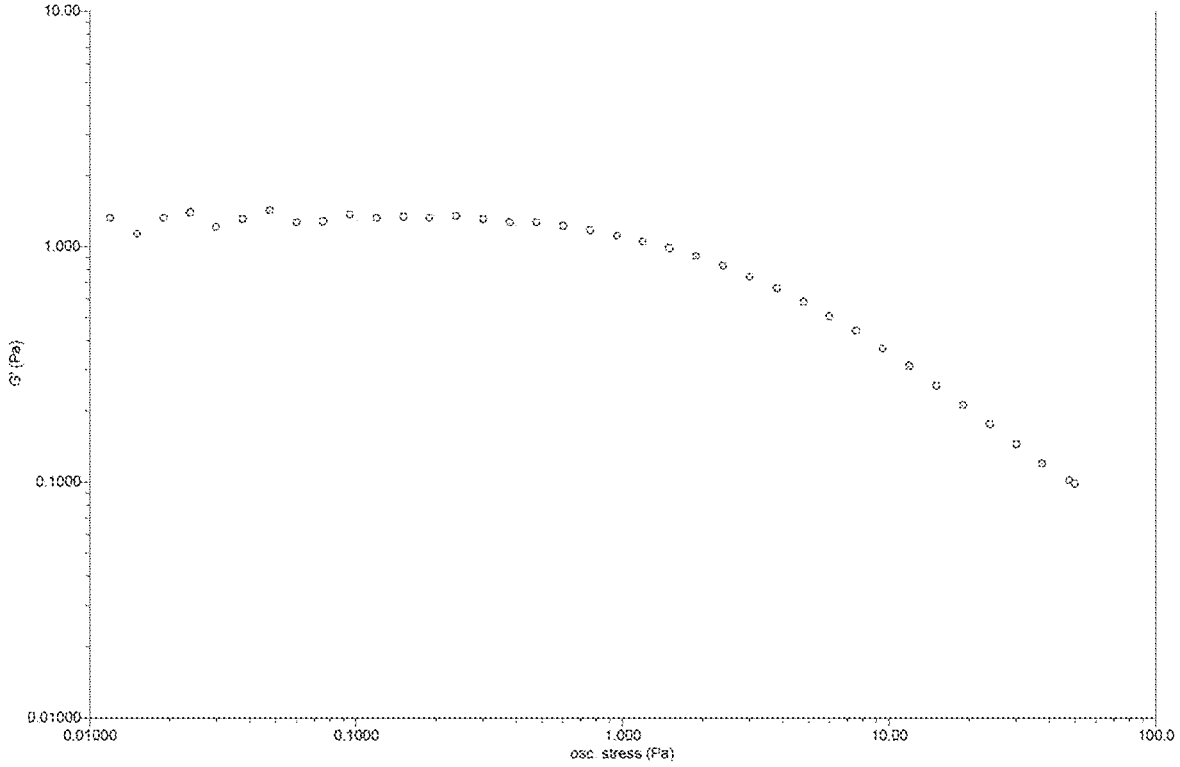
FIG. 5 is an oscillatory yield stress graph of a sample of the second version of Inventive Composition 1 that is allowed to stand at room temperature overnight. This graph shows that an yield stress point is observed thereby indicating that the composition is structured. More specifically, the yield stress point is observed at about 2.168 Pa and a G' of about 1.202 Pa.
Figure 6:
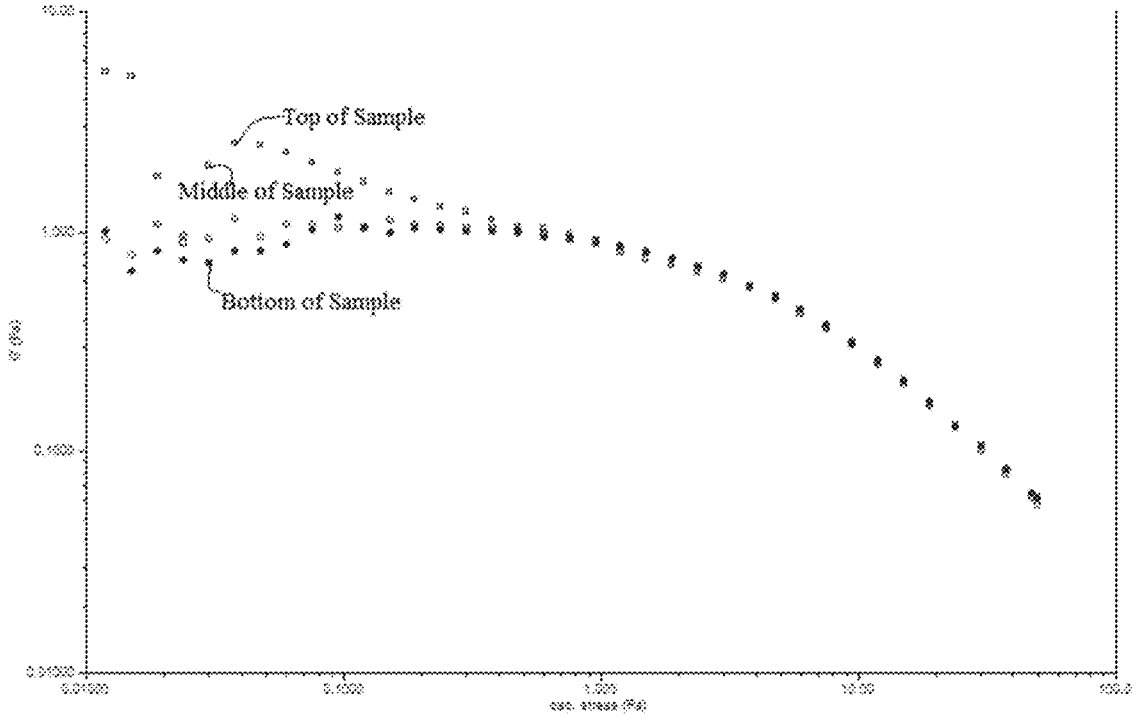
FIG. 6 is an oscillatory yield stress graph of a sample of the second version of Inventive Composition 1 that is stored for one month at 125° F. Measurements are taken at the top, middle, and bottom of the sample, as determined visually. This graph shows that an yield stress point is observed in all of the top, middle, and bottom, thereby indicating that the composition is structured. More specifically, the yield stress point is observed at the top at about 3.527 Pa and a G' of about 0.6458 Pa. The yield stress point is observed at the middle at about 3.748 Pa and a G' of about 0.7913 Pa. The yield stress point is observed at the bottom at about 4.187 Pa and a G' of about 0.7288 Pa.

This disclosure provides a structured detergent composition. For purposes of this disclosure, the difference between an unstructured detergent composition and a structured detergent composition is the presence of a yield stress point, e.g. as shown in FIGS. 5 and 6 as compared to a lack of a yield stress point in FIG. 4.

The yield stress is an important characteristic of structured fluids because it helps stabilize the material. A higher yield stress prevents the material from undergoing phase separation, sedimentation or aggregation. It reduces flow under shipping vibrations and gravity. Yield stress studies can help evaluate the product performance and processability and predict product's long-term stability and shelf life. A yield stress in rheology is typically defined as the applied stress at which irreversible plastic deformation is first observed across the sample. It is usually represented as $\sigma y$. However, the value of yield stress can depend on the testing method. Therefore, in some embodiments, the measured yield stress can be described as an "apparent yield stress". One method used to determine yield stress involves use of continuous shear stress or shear rate ramp, from low to high stress or rate. The yield stress is usually determined by fitting the stress/rate curves with Bingham, Casson or Herschel-Bulkley models. Also manual extrapolation of the stress curve to zero shear rate is frequently used to obtain a yield stress. In a shear stress (rate) ramp, the yield stress can be determined from the transient viscosity maximum in a double logarithmic plot of viscosity versus stress (Maximum viscosity method). Since these test methods are performed under nonsteady state conditions, the measured yield stress value can be dependent on the experimental ramp rate.

A common procedure for yield stress analysis is a steady state stress sweep on a controlled stress rheometer. In such experiments, a stress or torque is incrementally stepped logarithmically from a minimum value up to a value where the material starts to flow. Each stress is held on the material for a given amount of time. A software algorithm evaluates the data and a data point is taken when the shear rate reaches an equilibrium value. Below the yield point, the change in shear rate with stress is extremely small. The viscosity remains constant with increasing stress and is referred to as the zero shear viscosity. At a given stress, the material starts to flow, the material yields as the viscosity decreases many orders of magnitude over a narrow range of shear stress. The yield stress value can be obtained either by taking the very last data point before the viscosity starts to drop significantly, or by taking the onset value from the viscosity curve. The accuracy of the yield stress measured will be dependent on the number of points per decade chosen, when programming the test parameters. For example, when choosing five points per decade in a logarithmic sweep, the successive data points will be much further apart than when choosing ten points per decade. Therefore, collecting more data points per decade provides a more accurate yield stress, if the material remains stable during the test.

A steady state flow shear rate sweep test can also be used to analyze the yield behavior. When performing this test, the sample can be loaded either onto a cone-plate, parallel plate or cup/bob geometry. The shear rate is controlled during the test, and is stepped down logarithmically from high (e.g., 10 l/s or 100 l/s) to low (e.g., 10-5 l/s) values. When the yield point has been reached, the stress on the sample reaches a plateau and becomes independent of rate. Concomitantly, the "apparent" viscosity ($\eta a$) of the sample goes to infinity with decreasing shear rate. The benefit of this test method is that by sweeping the shear rate from high to low, all sample history from loading is eliminated. The measurement results show good reproducibility.

The dynamic oscillation stress/strain sweep test is an alternative method to analyze the yield behavior. To perform this test, cone-plate or plate-plate geometries are used predominately. The results are best viewed in a double logarithmic plot of the storage modulus (G') as function of oscillation stress. The yield stress is the critical stress at which irreversible plastic deformation occurs. The yield stresses can be taken as the onset value of the modulus curves. The dynamic stress/strain sweep method can be used for materials with wide ranges of viscosities. The test can be performed on both controlled stress and controlled strain rheometers.

Figure 4:
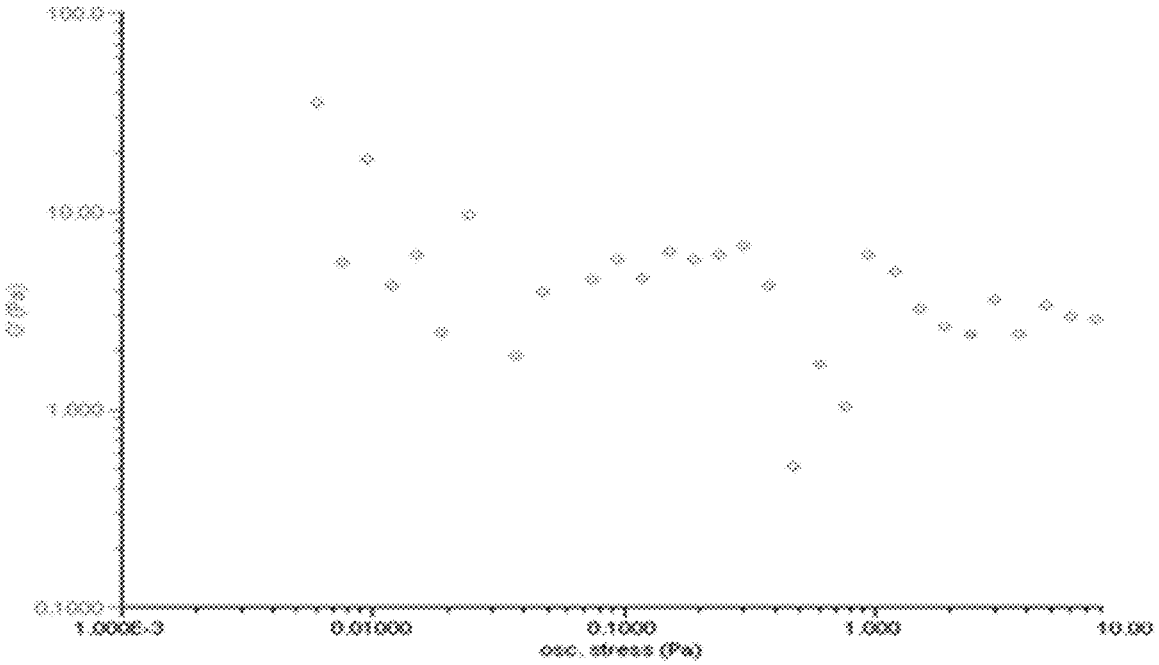
FIG. 4 is an oscillatory yield stress graph of a sample of the first version of Inventive Composition 1 that shows that no yield stress point is observed thereby indicating that the composition is not structured. More specifically, this Figure shows that the points on the graph are scattered thereby indicating that there is no yield stress point.

For example, FIG. 4 is an oscillatory yield stress graph that shows that no yield stress point is observed thereby indicating that the composition is not structured. More specifically, this Figure shows that the points on the graph are scattered thereby indicating that there is no yield stress point. FIG. 5 is an oscillatory yield stress graph of one of the Examples that shows that an yield stress point is observed thereby indicating that the composition is structured. FIG. 6 is an oscillatory yield stress graph of another example that also shows that an yield stress point is observed from samples taken from the top, middle, and bottom of the composition, thereby indicating that the composition is structured.

Viscosity can also play a role in determining structuring. However, it is not dispositive for this disclosure. For example, in various embodiments, the structured detergent composition has a viscosity of at least about 150 centipoise e.g. as measured using an AR2000-EX Rheometer at a shear rate of 1.08 l/s over 5 minutes at 20° C. with a geometry cone of 40 mm, 1:59:49 degree:min:sec, and a truncation gap of 52 microns. In other embodiments, the structured detergent composition has a viscosity of at least about 100 Pa·s, e.g. as measured using an AR2000-EX Rheometer at a shear rate of 1.08 l/s over 5 minutes at 20° C. with a geometry cone of 40 mm, 1:59:49 degree:min:sec, and a truncation gap of 52 microns. In various embodiments, this viscosity is at least about 105, 110, 115, 120, 125, 130, 135, 140, 145, 150, 155, 160, 165, 170, 175, 180, 185, 190, 195, or 200, Pa·s, e.g. as measured using an AR2000-EX Rheometer at a shear rate of 1.08 l/s over 5 minutes at 20° C. with a geometry cone of 40 mm, 1:59:49 degree:min:sec, and a truncation gap of 52 microns. The upper viscosity is not particularly limited and may be chosen by one of skill in the art. In various embodiments, the upper viscosity is about 200, 225, 250, 300, 350, 400, 450, 500, 750, 1000, 1250, 1500, etc., Pa·s, e.g. as measured using an AR2000-EX Rheometer at a shear rate of 1.08 l/s over 5 minutes at 20° C. with a geometry cone of 40 mm, 1:59:49 degree:min:sec, and a truncation gap of 52 microns. In various non-limiting embodiments, all values, both whole and fractional, between and including all of the above, are hereby expressly contemplated for use herein.

The terminology "structured" may alternatively be described as "gelled" such that a structured detergent composition may be alternatively described as a gelled detergent composition, as would be appreciated by one of skill in the art.

The viscosity may be alternatively measured using different methods, such as by using a Brookfield viscometer and any one or more spindles, as is chosen by one of skill in the art. In various embodiments, the composition has one or more of the aforementioned viscosities that is measured using a DV2T Brookfield viscometer at 20 rpm and 70° F. using spindle LV02(62). In various non-limiting embodiments, all values, both whole and fractional, between and including all of the above, are hereby expressly contemplated for use herein.

Higher viscosities may or may not be associated with structuring. For example, a highly viscous composition may or may not be structured, i.e., have a yield stress point. Similarly, a less viscous composition also may or may not be structured, i.e., have a yield stress point. Therefore, although higher viscosities tend to be associated with structuring, this is not always the case.

The structured detergent composition may be, include, consist essentially of, or consist of, a surfactant component, water, and a smectite clay.

The structured detergent composition may be, include, consist essentially of, or consist of, a surfactant component, water, a smectite clay, and an active agent.

The structured detergent composition may be, include, consist essentially of, or consist of, a surfactant component, water, a smectite clay, and an encapsulated active agent.

The structured detergent composition may be, include, consist essentially of, or consist of, a surfactant component, water, a smectite clay, an encapsulated active agent, and an unencapsulated active agent.

In various embodiments, structured detergent composition may be, include, consist essentially of, or consist of, a surfactant component including an alcohol ethoxy sulfate, a linear alkyl benzene sulfonate, and a $C_8$-$C_{20}$ alkoxylated alcohol, water, and a smectite clay.

In various embodiments, structured detergent composition may be, include, consist essentially of, or consist of, a surfactant component including an alcohol ethoxy sulfate, a linear alkyl benzene sulfonate, and a $C_8$-$C_{20}$ alkoxylated alcohol, water, a smectite clay, and at least one active agent, which may be encapsulated, not encapsulated, or a mixture of encapsulated and not encapsulated active agents.

In one embodiment, structured detergent composition comprises a surfactant component including an alcohol ethoxy sulfate, a linear alkyl benzene sulfonate, and a $C_8$-$C_{20}$ alkoxylated alcohol, water, and a smectite clay.

In one embodiment, structured detergent composition comprises a surfactant component including an alcohol ethoxy sulfate, a linear alkyl benzene sulfonate, and a $C_8$-$C_{20}$ alkoxylated alcohol, water, a smectite clay, and at least one active agent, which may be encapsulated, not encapsulated, or a mixture of encapsulated and not encapsulated active agents.

In another embodiment, structured detergent composition consists essentially of a surfactant component including an alcohol ethoxy sulfate, a linear alkyl benzene sulfonate, and a $C_8$-$C_{20}$ alkoxylated alcohol, water, and a smectite clay.

In another embodiment, structured detergent composition consists essentially of a surfactant component including an alcohol ethoxy sulfate, a linear alkyl benzene sulfonate, and a $C_8$-$C_{20}$ alkoxylated alcohol, water, a smectite clay, and at least one active agent, which may be encapsulated, not encapsulated, or a mixture of encapsulated and not encapsulated active agents.

In various embodiments, structured detergent composition may be, include, consist essentially of, or consist of: a surfactant component present in an amount of from about 5 to about 35 weight percent actives based on a total weight of the composition, water present in an amount of from about 50 to about 80 weight percent based on a total weight of the composition, and a smectite clay present in an amount of from about 0.2 to about 1.5 weight percent actives based on a total weight of the composition. It is also contemplated that, in various non-limiting embodiments, all values and ranges of values, both whole and fractional, including and between those set forth above, are hereby expressly contemplated for use herein.

In one embodiment, structured detergent composition comprises a surfactant component including an alcohol ethoxy sulfate having a $C_8$-$C_{20}$ backbone that is ethoxylated with from about 1 to about 10 moles of ethylene oxide and present in an amount of from about 3 to about 5 weight percent actives based on a total weight of the structured detergent composition, a linear alkyl benzene sulfonate present in an amount of from about 1 to about 2 weight percent actives based on a total weight of the structured detergent composition, $C_8$-$C_{20}$ alcohol alkoxylated with about 2 to about 12 moles of an alkylene oxide and present in an amount of from about 6 to about 8 weight percent actives based on a total weight of the structured detergent composition, water, and a smectite clay. It is also contemplated that, in various non-limiting embodiments, all values and ranges of values, both whole and fractional, including and between those set forth above, are hereby expressly contemplated for use herein.

In another embodiment, structured detergent composition comprises a surfactant component present in an amount of about 10 to about 15 weight percent actives based on a total weight of the structured detergent composition. The surfactant component includes an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the structured detergent composition, a linear alkyl benzene sulfonate present in an amount of from about 1 to about 2 weight percent actives based on a total weight of the structured detergent composition, $C_8$-$C_{20}$ alcohol alkoxylated with about 2 to about 12 moles of an alkylene oxide and present in an amount of from about 6 to about 8 weight percent actives based on a total weight of the structured detergent composition. In this embodiment, the structured detergent composition also includes water present in an amount of about 50 to about 80 weight percent based on a total weight of the structured detergent composition and a smectite clay, such as hectorite clay, present in an amount of from about 0.3 to 0.5 weight percent actives based on a total weight of the structured detergent composition. It is also contemplated that, in various non-limiting embodiments, all values and ranges of values, both whole and fractional, including and between those set forth above, are hereby expressly contemplated for use herein.

In still another embodiment, structured detergent composition consists essentially of a surfactant component present in an amount of about 10 to about 15 weight percent actives based on a total weight of the structured detergent composition. The surfactant component includes an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the structured detergent composition, a linear alkyl benzene sulfonate present in an amount of from about 1 to about 2 weight percent actives based on a total weight of the structured detergent composition, $C_8$-$C_{20}$ alcohol alkoxylated with about 2 to about 12 moles of an alkylene oxide and present in an amount of from about 6 to about 8 weight percent actives based on a total weight of the structured detergent composition. In this embodiment, the structured detergent composition also includes water present in an amount of about 50 to about 80 weight percent based on a total weight of the structured detergent composition and a smectite clay, such as hectorite clay, present in an amount of from about 0.3 to 0.5 weight percent actives based on a total weight of the structured detergent composition. It is also contemplated that, in various non-limiting embodiments, all values and ranges of values, both whole and fractional, including and between those set forth above, are hereby expressly contemplated for use herein.

In still other embodiments, structured detergent composition may comprise, consist essentially of, or consist of, any combination of components described herein, in any amounts described herein. For example, any of the aforementioned embodiments may also include any one or more of the additives or other components described below or in the Examples.

In further embodiments, structured detergent composition is free of, or includes less than 1, 0.5, 0.1, 0.05, or 0.01, weight percent of, any one or more of the optional components or additives described below and/or those such as, but not limited to, surfactants other than those of the surfactant component described above, aqueous solvents such as alcohols, non-aqueous solvents, fillers, polymers, etc. It is also contemplated that, in various non-limiting embodiments, all values and ranges of values, both whole and fractional, including and between those set forth above, are hereby expressly contemplated for use herein.

Surfactant Component

As first introduced above, structured detergent composition includes the surfactant component. The surfactant component may be, include, consist essentially of, or consist of, any surfactants known in the art. However, in typical embodiments, the surfactant component may be, include, consist essentially of, or consist of, an alcohol ethoxy sulfate, a linear alkyl benzene sulfonate, and/or a $C_8$-$C_{20}$ alkoxylated alcohol, each described in greater detail below. The surfactant component may include, or be free of, one or more than one of each of the aforementioned surfactant types.

In various embodiments, the surfactant component is present in an amount of from about 5 to about 50, about 10 to about 45, about 15 to about 40, about 20 to about 35, about 25 to about 30, about 5 to about 35, or about 10 to about 15, about 12 to about 15, or about 13 to about 15, weight percent actives based on a total weight of the composition. It is also contemplated that, in various non-limiting embodiments, all values and ranges of values, both whole and fractional, including and between those set forth above, are hereby expressly contemplated for use herein.

Alcohol Ethoxy Sulfate

The surfactant component typically includes the alcohol ethoxy sulfate, which may be described as an anionic surfactant. Without intending to be bound by any particular theory, it is believed that the alcohol ethoxy sulfate may assist in gelation and structuring of the structured detergent composition.

The alcohol ethoxy sulfate typically has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. It is also contemplated that, in various non-limiting embodiments, all values and ranges of values, both whole and fractional, including and between those set forth above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide.

In various embodiments, the alcohol ethoxy sulfate is present in an amount of from about 1 to about 20, about 1 to about 15, about 1 to about 10, about 1 to about 5, about 1 to about 3, about 3 to about 15, about 3 to about 10, about 3 to about 5, weight percent actives based on a total weight of the composition. In various non-limiting embodiments, all values, both whole and fractional, between and including all of the above, are hereby expressly contemplated for use herein.

Linear Alkylbenzene Sulfonate

The surfactant component may also include a linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. The linear alkylbenzene sulfonate (LAS), may be present in an amount of about 1 to about 10, about 5 to about 10, about 1 to about 5, about 1, 2, 3, 4, 5, 6, 7, 8, 9, or 10, or about 1 to about 2, weight percent actives based on a total weight of the composition. In various non-limiting embodiments, all values, both whole and fractional, between and including all of the above, are hereby expressly contemplated for use herein.

Alkoxylated Alcohol

The surfactant component may also include a $C_8$-$C_{20}$ alkoxylated alcohol, which may be described as an alcohol alkoxylate or as a non-ionic surfactant. The $C_8$-$C_{20}$ alcohol is capped with (or comprises), or is alkoxylated with, approximately 2 to 12 moles of an alkylene oxide. In other embodiments, the alcohol alkoxylate has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

The alkoxylated alcohol may be present in an amount of from about 1 to about 20, about 1 to about 15, about 1 to about 10, about 1 to about 5, about 5 to about 10, or about 6 to about 8, weight percent actives based on a total weight of the composition. In various non-limiting embodiments, all values, both whole and fractional, between and including all of the above, are hereby expressly contemplated for use herein.

Additional Surfactants

The structured detergent composition may also include, or be free of, one or more additional surfactants. The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from structured detergent composition.

In other embodiments, the one or more additional surfactants may be or include anionic surfactants which include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In other embodiments, the additional surfactant is or includes a zwitterionic (or amphoteric) surfactant such as a sultaine, a betaine, such as cocamidopropyl betaine, and the like, and combinations thereof. In various non-limiting embodiments, all values, both whole and fractional, between and including all of the above, are hereby expressly contemplated for use herein.

Water

Water can be present in structured detergent composition in varying amounts. In various embodiments, water present is in a total amount of from about 40 to about 90 weight percent based on a total weight of the composition. For example, in various embodiments, water may be present in a total amount of about 40, 45, 50, 55, 60, 65, 70, 75, 80, 85, or 90, weight percent based on a total weight of the composition. In other embodiments, water is present in a total amount of from about 50 to about 80, about 55 to about 75, or about 60 to about 65, weight percent based on a total weight of the composition. Typically, the terminology "total amount" refers to a total amount of water present in the composition from all components, i.e., not simply water added independently from, for example, the surfactant component, etc. Typically, the instant composition is described as a liquid laundry detergent which tends to have a higher water content than other detergents such as single dose laundry detergents. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Non-Aqueous Solvent Component

The structured detergent composition may also include, or be free of, a non-aqueous solvent component. The non-aqueous solvent component may include or be a single non-aqueous solvent or two or more non-aqueous solvents. The amount of the non-aqueous solvent component is not particularly limited. In various embodiments, the non-aqueous solvent component is present in an amount of from about 1 to about 40, about 5 to about 35, about 10 to about 30, about 15 to about 25, about 25 to about 30, about 25 to about 35, about 30 to about 40, about 35 to about 40, or about 15 to about 20, weight percent actives based on a total weight of the composition. In various non-limiting embodiments, all values, both whole and fractional, between and including all of the above, are hereby expressly contemplated for use herein.

The non-aqueous solvent that is or is part of the non-aqueous solvent component is not particularly limited and may be any known in the art. In various embodiments, the non-aqueous solvent is chosen from monoethanolamine, glycerine, propylene glycol, and combinations thereof. For example, the non-aqueous solvent may be monoethanolamine. In another embodiment, the non-aqueous solvent may be glycerine. In a further embodiment, the non-aqueous solvent may be propylene glycol.

In other embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block co-polymers. In various non-limiting embodiments, all values, both whole and fractional, between and including all of the above, are hereby expressly contemplated for use herein.

Additives

The structured detergent composition may include one or more of the following additives or may be free of one or more of the following additives. For example, the structured detergent composition may include one or more foam inhibitors (e.g. defoaming agents). Suitable foam inhibitors include, but are not limited to, fatty acids such as coconut fatty acids. The structured detergent composition may include the foam inhibitor at an amount of from about 0 to about 10, about 0.1 to about 5, about 0.1 to about 1, or about 0.25 to about 0.75, weight percent actives, based on the total weight of structured detergent composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art. For example, the additives may include metal hydroxides, such as sodium or potassium hydroxide, organic acids such as citric acid, mineral acids, dyes, anti-redeposition agents such as sodium polyacrylate, enzymes such as proteases, amylases, mannanases, chelators, preservatives, fragrances, colorants, opacifiers, tints, etc. In one embodiment, the additives include a base, such as sodium hydroxide, an acid such as citric acid, and a buffer, such as triethanolamine.

Any one or more of these can be chosen by one of skill in the art both in type and in amount. In various embodiments, any one or more of these may be present in an amount of from about 0.01 to about 3 weight percent actives based on a total weight of the composition. For example, any one or more can be present in an amount of from about 0.01 to about 0.09, about 0.02 to about 0.08, about 0.03 to about 0.07, about 0.04 to about 0.06, about 0.05 to about 0.06, about 0.1 to about 0.9, about 0.2 to about 0.8, about 0.3 to about 0.7, about 0.4 to about 0.6, about 0.5 to about 0.6, about 1 to about 3, about 1.5 to about 2.5, or about 1.5 to about 2, weight percent actives based on a total weight of the composition. In various non-limiting embodiments, all values, both whole and fractional, between and including all of the above, are hereby expressly contemplated for use herein.

Active Agent

In various embodiments, the composition includes an active agent. Alternatively, the composition may be free of an active agent. The active agent may be encapsulated or non-encapsulated. The encapsulation may be total or partial. A single active agent or two or more active agents may be used. The composition may include one or more encapsulated active agents and one or more non-encapsulated active agents. The composition may include one or more encapsulated active agents and be free of one or more non-encapsulated active agents. Alternatively, the composition may be free of one or more encapsulated active agents and include one or more non-encapsulated active agents.

The active agent is not particularly limited and may be further described as bleaches, stain removal agents, polymers, dyes, proteins, enzymes, optical brightening agents, conditioning agents, skin care ingredients, fabric conditioners and combinations thereof. The active agent is not particularly limited in amount and may be present in amounts of from about 0.01 to about 5; about 0.1 to about 5; about 0.1 to about 2; about 0.1 to about 1; about 0.2 to about 0.4; about 0.001 to about 1; about 0.01 to about 0.5; about 0.01 to about 0.2; about 0.08 to about 0.12; about 0.07 to about 0.09; about 0.01 to about 0.03; about 0.005 to about 0.015; about 0.05 to about 0.07; about 0.04 to about 0.06; about 0.4 to about 0.6; about 0.05 to about 0.25; about 0.05 to about 0.10; about 0.05 to about 0.15; about 0.10 to about 0.15; about 0.010 to about 0.020; etc. In various non-limiting embodiments, all values, both whole and fractional, between and including all of the above, are hereby expressly contemplated for use herein. In one embodiment, the active agent suspended in the composition and is present in an amount of greater than zero and up to about 5 weight percent actives based on a total weight of the composition. In another embodiment, at least one active agent is encapsulated and suspended in the composition wherein the encapsulated active agent is present in an amount of greater than zero and up to about 1 weight percent actives based on a total weight of the composition. In various non-limiting embodiments, all values, both whole and fractional, between and including all of the above, are hereby expressly contemplated for use herein.

Smectite Clay

The structured detergent composition also includes the smectite clay. As is known in the art, smectite clay can include a group of phyllosilicate mineral species such as montmorillonite, beidellite, nontronite, saponite, hectorite, and disteardimonium hectorite. These types can be differentiated by variations in chemical composition involving substitutions of Al for Si in tetrahedral cation sites and Al, Fe, Mg and Li in octahedral cation sites. Smectite clays have a variable net negative charge, which is balanced by Na, Ca, Mg and, or, H adsorbed externally on interlamellar surfaces. The structure, chemical composition, exchangeable ion type and small crystal size of smectite clays allow for a large chemically active surface area, a high cation exchange capacity, interlamellar surfaces having hydration characteristics, etc. Natural smectite clays can be divided into Na smectites, Ca—Mg smectites and Fuller's or acid earths. In various embodiments, the smectite clay is chosen from hectorite, disteardimonium hectorite, and combinations thereof.

The hectorite is present in an amount of from about 0.2 to about 3 weight percent actives based on a total weight of the composition. In various embodiments, the hectorite is present in an amount of from about 0.2 to about 2, about 0.2 to about 1.5, about 0.2 to about 1, about 0.2 to about 0.5, about 0.3 to about 1, about 0.3 to about 0.7, or about 0.3 to about 0.5, weight percent actives based on a total weight of the composition. In various non-limiting embodiments, all values, both whole and fractional, between and including all of the above, are hereby expressly contemplated for use herein.

Weight Percents/Ratios of Various Components

The surfactant component, water, and smectite clay and optional additive additives are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, the alcohol ethoxy sulfate is sodium laureth sulfate ethoxylated with about 2 to about 4 moles of ethylene oxide and is present in an amount of from about 4 to about 6 weight percent actives based on a total weight of the structured detergent composition, the linear alkyl benzene sulfonate is present in an amount of from about 1 to about 2 weight percent actives based on a total weight of the structured detergent composition, and the alcohol is a $C_{12}$-$C_{15}$ alcohol ethoxylated with about 6 to about 8 moles of ethylene oxide and is present in an amount of from about 6 to about 7 weight percent actives based on a total weight of the structured detergent composition.

In still other embodiments, any one or more of the components set forth below may be present in an amount set forth below, relative to weight percent actives based on a total weight of structured detergent composition. All combinations of components and weight percents below are hereby expressly contemplated in various non-limiting embodiments. All weights are approximate.

| Component | Non-Limiting Options for Approximate Weight Percent Actives |
|---|---|
| Linear Alkyl Benzene Sulfonate | 0.1-10; 1-8; 1-5; 1-3; 1-2 |
| Sodium Laureth Sulfate | 1-15; 2-12; 3-9; 4-8; 3-4 |
| Alcohol Ethoxylate* | 1-15; 2-12; 3-9; 4-8; 6-7 |
| Coconut Oil Fatty Acid | 0.1-5; 0.1-2; 0.1-1; 0.4-0.6 |
| Amphoteric Surfactant* (e.g. a betaine) | 0.1-5; 0.1-2; 0.1-1; 0.7-0.8 |
| Triethanolamine | 0.1-5; 0.1-2; 0.1-1; 0.6-0.7 |
| Metal Hydroxide* (e.g. Sodium Hydroxide) | 0.1-10; 1-8; 1-5; 1-3; 1-2 |
| Acid* (e.g. Citric Acid) | 0.1-10; 1-8; 1-5; 1-3; 2-3 |
| Smectite Clay | 0.01-5; 0.1-5; 0.1-2; 0.1-1; 0.2-0.4 |
| Chelator* | 0.01-5; 0.1-5; 0.1-2; 0.1-1; 0.2-0.4 |
| F-dye* | 0.001-1; 0.01-0.5; 0.01-0.2; 0.08-0.12 |
| Anti-Redeposition Agent* | 0.001-1; 0.01-0.5; 0.01-0.2; 0.07-0.09 |
| Protease* | 0.001-1; 0.01-0.5; 0.01-0.2; 0.01-0.03 |
| Amylase* | 0.001-1; 0.01-0.5; 0.01-0.2; 0.005-0.015 |
| Mannanase* | 0.001-1; 0.01-0.5; 0.01-0.2; 0.01-0.03 |
| Preservative* | 0.001-1; 0.01-0.5; 0.01-0.2; 0.05-0.07 |
| Calcium Chloride | 0.001-1; 0.01-0.5; 0.01-0.2; 0.04-0.06 |
| Fragrance* | 0.1-5; 0.1-2; 0.1-1; 0.4-0.6 |
| Encapsulated Fragrance* | 0.01-0.5; 0.05-0.25; 0.05-0.10; 0.05-0.15; 0.10-0.15 |
| Dye* | 0.001-1; 0.01-0.5; 0.01-0.2; 0.010-0.020 |
| Opacifier* | 0.01-2; 0.1-2; 0.1-2; 0.1-1; 0.05-0.15 |

*is indicative that any known in the art may be used.

The composition may include particles of the smectite clay and/or any other components described herein. In various embodiments, the composition is structured such that there is a consistent distribution of particles throughout a sample. For example, samples can be evaluated using a fiber optic particle size analyzer which determines distribution of particles between a top, middle, and bottom of a sample. As shown in the Examples, the particle sizes of interest are typically those <10 microns, 10-50 micros, and 50-100 microns. More specifically, the particle distribution determinations are made using the method described in the Examples. These consistent distribution results are surprising and superior to what would otherwise be expected in the art.

The composition may exhibit one or more than one of the superior and unexpected results without a negative effect on stain removal performance, as is shown in the Examples. This stain removal performance may be performed using any method known in the art, e.g. using standard stain tests known in the industry at both 90° F. and 59° F.

Method of Forming the Structured Detergent Composition

This disclosure also provides a method of forming the structured detergent composition. The method includes the steps of combining water and a smectite clay to form a mixture, applying shear to the mixture, combining the sheared mixture with an acidic surfactant, subsequently adding an acid to the combination of the sheared mixture and the acidic surfactant, and then adding a base and a buffer to the combination of the sheared mixture, the acidic surfactant, and the acid. The method also includes the step of adding additional surfactants, wherein the combination of the acidic surfactant and the additional surfactants comprise or make up the surfactant component.

The step of combining to form a mixture can be further defined as combining the water and the smectite clay together in a mixer in any order and in one or more parts.

After the mixture is formed, the method includes the step of applying shear to the mixture. Typically, shear is applied to the mixture via use of a homogenizer. However, any shear-applying device can be used. For example, any type of homogenizer may be used. Common types include rotor/stator generators (or colloid mills), high pressure (or piston pump) types, and sonic disruptors. For example, rotor/stator homogenizers are the most common type and shear material in a long shaft that has angled knives at the bottom. The knives shred the material, which is then drawn up into a stator tip and ejected from small holes in the side of the stator to be sheared again. High pressure homogenizers can also be used and typically force material through small tubes or valves with a piston pump under high pressures (up to 1,500 bar/21,750 psi with continuous full-scale operation). Sonic disruptors can also be used which generate ultrasonic waves ranging from about 18 to 50 kHz which can exert high pressure and temperature on the materials.

The step of applying shear can be utilized for any amount of time as chosen by one of skill in the art. Typically, this step occurs for a time of about 1 to about 10, about 2 to about 8, about 3 to about 7, about 4 to about 6, or about 5, minutes. Moreover, the speed of the homogenizer or shear applying device may be chosen by one of skill in the art. Typically, after applying shear/homogenizing, the mixture remains fluid and not gelled and does not include much, if any, air entrapment. In various non-limiting embodiments, all values, both whole and fractional, between and including all of the above, are hereby expressly contemplated for use herein.

After the mixture is sheared using the aforementioned step, the sheared mixture is combined with the acidic surfactant, as is described above. The sheared mixture and the acidic surfactant may be combined in any manner. For example, the acidic surfactant may be added to the sheared mixture or the sheared mixture may be added to the acidic surfactant. This combination may occur in a single step or multiple steps. Typically, upon combination of the sheared mixture and the acidic surfactant, the viscosity of the mixture begins to increase and the mixture begins to structure. The acidic surfactant may be any described above and typically is linear alkylbenzene sulfonate (LAS).

After the sheared mixture is combined with the acidic surfactant, acid is then added to the combination of the sheared mixture and the acidic surfactant. The acid may be any described above, such as citric acid. Notably, the order of addition of first adding the acidic surfactant and then adding the acid is important because it allows the structure to remain intact. If more basic components are added first, the structure of the composition is observed to break and become unusable.

After the acid is added, a base is then added. In other words, the base is added to the combination of the (sheared mixture, the acidic surfactant, and the acid). The base can be any case described above, such as sodium hydroxide, an amine base, etc. Then, after the base is added, the buffer is added. In other words, the buffer is added to the combination of the (sheared mixture, the acidic surfactant, the acid, and the base). The buffer is added after the base and this is important because, again, it preserves the structuring of the composition. As shown in the Examples below, this order of addition of components surprisingly and unexpectedly forms a stable product whereas changing the order of addition tends to form an unstable product.

In another embodiment, the method further includes the step of adding at least one active agent subsequent to the steps of adding the base and the buffer.

In another embodiment, at least one active agent is encapsulated and suspended in the structured detergent composition wherein the encapsulated active agent is present in an amount of greater than zero and up to about 1 weight percent actives based on a total weight of the composition.

In another embodiment, the encapsulated active agent is a fragrance.

In another embodiment, the detergent composition further comprises an additional active agent that is not encapsulated.

In another embodiment, the at least one active agent is suspended in the structured detergent composition and is present in an amount of greater than zero and up to about 5 weight percent actives based on a total weight of the composition.

In another embodiment, the smectite clay is chosen from hectorite clay, disteardimonium hectorite clay, and combinations thereof.

In another embodiment, the surfactant component comprises:

an alcohol ethoxy sulfate having a $C_5$-$C_{20}$ backbone that is ethoxylated with from about 1 to about 10 moles of ethylene oxide;

a linear alkylbenzene sulfonate; and an ethoxylated alcohol comprising a $C_5$-$C_{20}$ backbone that is ethoxylated with from about 2 to about 12 moles of ethylene oxide.

In another embodiment, the surfactant component is present in an amount of from about 5 to about 35 weight percent actives based on a total weight of the detergent composition.

In another embodiment, the water is present in an amount of from about 50 to about 80 weight percent based on a total weight of the detergent composition.

In another embodiment, the smectite clay is present in an amount of from about 0.2 to about 1.5 weight percent actives based on a total weight of the detergent composition.

In another embodiment, the smectite clay is hectorite clay and the smectite clay is present in an amount of from about 0.2 to about 1.5 weight percent actives based on a total weight of the detergent composition.

In another embodiment, the smectite clay is chosen from hectorite clay, disteardimonium hectorite clay, and combinations thereof.

In another embodiment, the surfactant component is present in an amount of from about 10 to about 15 weight percent actives based on a total weight of the composition, the water is present in an amount of from about 50 to about 80 weight percent based on a total weight of the composition, and the smectite clay is present in an amount of from about 0.3 to about 0.5 weight percent actives based on a total weight of the composition, and the composition further comprises an encapsulated fragrance suspended in the composition and present in an amount of from about 0.05 to about 0.15 weight percent actives based on a total weight of the composition. In a related embodiment, the smectite clay is chosen from hectorite clay, disteardimonium hectorite clay, and combinations thereof. In an alternative related embodiment, the smectite clay is hectorite clay. In a further related embodiment, the surfactant component comprises: an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the composition; a linear alkylbenzene sulfonate present in an amount of from about 1 to about 2 weight percent actives based on a total weight of the composition; and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of the composition. In a further related embodiment, the smectite clay is hectorite clay.

Method for Improving Optical Brightness and Whitening Maintenance

This disclosure also provides a method for improving optical brightness and whitening maintenance of a textile. The textile is not particularly limited and may be any known in the art. For example, the textile may be cotton or a cotton blend. In other embodiments, the textile is a polyester, nylon, cotton, woven blend, or combinations thereof.

Optical brightness is typically described as the perceived whiteness or brightness of a textile. In various embodiments, optical brightness can be determined using ASTM E313-10. Optical brightening is typically measured by an index. Numerous indices exist. The Ganz-Griesser Index is a calibrated method for accuracy. Various washing procedures can be utilized and the Ganz-Griesser Whiteness Index can be leveraged to calculate the level of whiteness impacted by the optical brightener (Delta Ganz=UV included−UV excluded).

Optical brightness is typically achieved through use of optical brighteners which are also known as fluorescent whitening agents. However, relative to the instant disclosure, these optical brighteners are not needed to achieve the surprising optical brightening results. As such, optical brighteners may be specifically excluded from the instant composition or may be included. These may include any known in the art.

Optical brighteners are excited by wavelengths of light in the near-ultraviolet (UV) range (360 to 365 nm) and then emit light in the blue range (400 to 440 nm) by fluorescence. Electrons in fluorescent molecules are excited into a higher energy state by absorption of light and then emit a small amount of heat plus fluorescence as the electrons return to their ground state. These compounds cause a whitening effect by compensating for a deficit in blue and purple light reflected by the textile with the blue and purple optical emission of the fluorophore. In this disclosure, use of the smectite clay was shown to increase optical brightness without use of an optical brightener. Moreover, as shown in the Examples, the smectite clay itself does not fluoresce. Therefore, it cannot be said that the smectite clay itself is acting as a fluorophore.

Whitening maintenance can also be described as anti-redeposition. In various embodiments, whitening maintenance can be determined using ASTM D4008. However, relative to the instant disclosure, anti-redeposition agents are not needed to achieve the surprising whitening maintenance results. As such, anti-redeposition agents may be specifically excluded from the instant composition or may be included. These may include any known in the art.

The method includes the step of providing the structured detergent composition. The structured detergent composition can be provided in any way and may be formed using the aforementioned method.

The method also includes the step of applying the structured detergent composition to a textile. The step of applying is typically further described as contacting or otherwise combining the structured detergent composition and the textile, e.g. in an industrial or consumer washing machine. The step of applying may be further defined as contacting the textile in a washing machine. The amount of the structured detergent composition that is applied to the textile is typically based on the recommended consumer dose, as is known by those of skill in the art. For example, an amount of about 1 to about 2, e.g. about 1.5 to about 1.6, ounces of the structured detergent composition, can be used per wash. In various non-limiting embodiments, all values, both whole and fractional, between and including all of the above, are hereby expressly contemplated for use herein.

The method further includes the step of washing the textile with the structured detergent composition such that the textile exhibits an optical brightness of greater than 70 delta ganz measured after five washes and exhibits a whitening maintenance of greater than 97 delta ganz measured after five washes. Notably, the method does not require that the textile be washed five times. However, in various embodiments, when the textile is washed five times, the textile will exhibit the aforementioned optical brightness and whitening maintenance.

In other embodiments, the textile exhibits an optical brightness of greater than 30, 35, 40, 45, 50, 55, 60, 65, or 70 delta ganz measured after one, two, three, four or five washes. The textile may exhibit a whitening maintenance of greater than 97, 98, or 99, delta ganz measured after one, two, three, four, or five washes. Typically, the optical brightness and the whitening maintenance are quantified using methods known in the art, such as the ones described above or those described below in the Examples. In various non-limiting embodiments, all values, both whole and fractional, between and including all of the above, are hereby expressly contemplated for use herein.

In an additional embodiment of this method, the surfactant component is present in an amount of from about 10 to about 15 weight percent actives based on a total weight of the composition, the water is present in a total amount of from about 50 to about 80 weight percent based on a total weight of the composition, and the smectite clay is hectorite and is present in an amount of from about 0.3 to about 0.5 weight percent actives based on a total weight of the composition.

In an additional embodiment of this method, the structured detergent composition further comprises an encapsulated fragrance suspended in the structured detergent composition and present in an amount of from about 0.05 to about 0.15 weight percent actives based on a total weight of the composition.

In an additional embodiment of this method, the surfactant component comprises an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the composition, a linear alkylbenzene sulfonate present in an amount of from about 1 to about 2 weight percent actives based on a total weight of the composition, and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of the composition.

In an additional embodiment of this method, the structured detergent composition further comprises an encapsulated fragrance suspended in the structured detergent composition and present in an amount of from about 0.05 to about 0.15 weight percent actives based on a total weight of the composition.

In an additional embodiment of this method, the surfactant component comprises an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the composition, a linear alkylbenzene sulfonate present in an amount of from about 1 to about 2 weight percent actives based on a total weight of the composition, and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of the composition.

In an additional embodiment of this method, the surfactant component comprises an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the composition, a linear alkylbenzene sulfonate present in an amount of from about 1 to about 2 weight percent actives based on a total weight of the composition, and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of the composition.

In an additional embodiment of this method, the composition further comprises at least one active agent suspended in the structured detergent composition and present in an amount of greater than zero and up to about 5 weight percent actives based on a total weight of the composition.

In an additional embodiment of this method, the at least one active agent is encapsulated and suspended in the structured detergent composition wherein the encapsulated active agent is present in an amount of greater than zero and up to about 1 weight percent actives based on a total weight of the composition.

In an additional embodiment of this method, the encapsulated active agent is a fragrance.

In an additional embodiment of this method, the composition further comprises an additional active agent that is not encapsulated.

In an additional embodiment of this method, the smectite clay is chosen from hectorite clay, disteardimonium hectorite clay, and combinations thereof.

In an additional embodiment of this method, the surfactant component comprises:

an alcohol ethoxy sulfate having a $C_8$-$C_{20}$ backbone that is ethoxylated with from about 1 to about 10 moles of ethylene oxide;

a linear alkylbenzene sulfonate; and an ethoxylated alcohol comprising a $C_8$-$C_{20}$ backbone that is ethoxylated with from about 2 to about 12 moles of ethylene oxide.

In an additional embodiment of this method, the surfactant component is present in an amount of from about 5 to about 35 weight percent actives based on a total weight of the composition.

In an additional embodiment of this method, the water is present in an amount of from about 50 to about 80 weight percent based on a total weight of the composition.

In an additional embodiment of this method, the smectite clay is present in an amount of from about 0.2 to about 1.5 weight percent actives based on a total weight of the composition.

In an additional embodiment of this method, the smectite clay is present in an amount of from about 0.2 to about 1.5 weight percent actives based on a total weight of the composition.

In an additional embodiment of this method, the surfactant component is present in an amount of from about 10 to about 15 weight percent actives based on a total weight of the composition, the water is present in an amount of from about 50 to about 80 weight percent based on a total weight of the composition, and the smectite clay is present in an amount of from about 0.3 to about 0.5 weight percent actives based on a total weight of the composition, and the composition further comprises an encapsulated fragrance suspended in the composition and present in an amount of from about 0.05 to about 0.15 weight percent actives based on a total weight of the composition. In a related embodiment, the surfactant component comprises: an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of the composition; a linear alkylbenzene sulfonate present in an amount of from about 1 to about 2 weight percent actives based on a total weight of the composition; and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of the composition. In another related embodiment, the smectite clay is hectorite clay.

Additional Embodiments of the Composition

In various embodiments, the composition may be free of one or more of a smectite-type clay selected from the group consisting of bentonite, pyrophylite, hectorite, saponite, sauconite, nontronite, talc and beidellite, such as Veegum, magnesium aluminum silicate or Laponite, and/or sodium lithium magnesium silicate, and/or combinations thereof, so long as the composition includes at least one smectite type clay.

In other embodiments, the composition may be free of builder components such as organic acids, alkali metal hydroxides, amines, and mixtures thereof.

In other embodiments, the composition may be free of chelator such as polycarboxylic acids, ethylenediaminetetraacetic acid, succinic acid, iminodisuccinic acid, salts thereof, or mixtures thereof.

In other embodiments, the composition may be free of a defoamer, an enzyme, a color component, a fragrance component, and/or mixtures thereof.

In other embodiments, the composition may be free of hydrous aluminum phylosilicates, sometimes with variable amounts of iron, magnesium, alkali metals, alkaline earths, and other cations.

In other embodiments, and so long as the composition includes at least one type of smectite clay, the composition may be free of other types including, but not limited to, dioctahedral smectites such as montmorillonite and nontronite and trioctahedral smectites for example saponite, bentonite, pyrophylite, hectorite, sauconite, talc, beidellite, sepiolite or attapulgite, clays with long water channels internal to their structure, phylosilicates, Halloysite, Kaolinite, Illite, Montmorillonite, Vermiculite, Talc, Palygorskite, Pyrophylite, kaolins, ilites, chlorites and attapulgites, bentonite, pyrophylite, saponite, sauconite, nontronite, talc and beidellite, etc.

In other embodiments, and so long as the composition includes at least one type of smectite clay, the composition may be free of other types including, synthetic smectites synthesized from a combination of metallic salts such as salts of sodium, magnesium and lithium with silicates, especially sodium silicates, at controlled ratios and temperature.

In other embodiments, the composition is free of one or more of internal and/or external structuring agents such as surfactants and electrolytes. polymers or gums, microgel particles, acrylate polymers, structuring gums (e.g., xanthan gum), starch, agar, hydroxyl alkyl cellulose, fibrous polymers (e.g., micro fibrous cellulose with large aspect ratios), parenchymal cellulose based materials, particulate cellulose material, or particular cellulose material containing, by dry weight, at least 60% cellulose, 0.5-10% pectin and 1-15% hemicellulose, hydrous aluminum phyllosilicates, and/or combinations thereof.

The instant disclosure requires the clay described herein and is free of any cellulose fiber. Moreover, the clay of this disclosure is stable on its own whereas cellulose fibers are not inherently stable and require additional stabilizing agents. The instant composition tends to trap less air than a composition that include cellulose fibers. In other embodiments, this disclosure is free of Laponite and Veegum both of which need co-structurants and do not provide adequate structuring.

Relative to the above, the terminology "free of" may describe the composition including less than 1, 0.5, 0.1, 0.05, or 0.01, weight percent of, any one or more of the aforementioned components, or the composition may include zero weight percent of any one or more of the aforementioned components. In all of the aforementioned embodiments, it is also contemplated that, in various non-limiting embodiments, all values and ranges of values, both whole and fractional, including and between those set forth above, are hereby expressly contemplated for use herein.

EXAMPLES

A series of compositions are contemplated, as set forth in Table 1 below. Two Comparative Compositions (Comparative Comp. 1 and 2) are contemplated along with four inventive compositions, (Inventive Comp. 1-4). The difference between these compositions is as follows:

The Comparative Compositions 1 and 2 do not include any smectite clay.

The Comparative Composition 1 does not include any encapsulated fragrance.

The Comparative Composition 2 include 0.05 weight percent of an encapsulated fragrance.

Inventive Compositions 1-4 each include smectite clay.

Each of Inventive Compositions 2-4 also includes an encapsulated fragrance in various amounts.

TABLE 1

| | Comparative Comps. 1/2 | Inventive Comp. 1 | Inventive Comp. 2 | Inventive Comp. 3 | Inventive Comp. 4 |
|---|---|---|---|---|---|
| | Approximate Wt % Actives | | | | |
| Linear Alkyl Benzene Sulfonate | 1.75 | 1.75 | 1.75 | 1.75 | 1.75 |
| Sodium Laureth Sulfate | 4.00 | 4.00 | 4.00 | 4.00 | 4.00 |
| C12-C15 Alcohol Ethoxylate - 7 E/O | 6.80 | 6.80 | 6.80 | 6.80 | 6.80 |
| Coconut Oil Fatty Acid | 0.50 | 0.50 | 0.50 | 0.50 | 0.50 |
| Amphoteric Surfactant | 0.75 | 0.75 | 0.75 | 0.75 | 0.75 |
| Triethanolamine | 0.64 | 0.64 | 0.64 | 0.64 | 0.64 |
| Sodium Hydroxide | 1.56 | 1.56 | 1.56 | 1.56 | 1.56 |
| Citric Acid | 2.25 | 2.25 | 2.25 | 2.25 | 2.25 |
| Smectite Clay | 0.00 | 0.30 | 0.30 | 0.30 | 0.30 |
| Chelator | 0.33 | 0.33 | 0.33 | 0.33 | 0.33 |
| F-dye | 0.09 | 0.09 | 0.09 | 0.09 | 0.09 |
| Anti-Redeposition Agent | 0.08 | 0.08 | 0.08 | 0.08 | 0.08 |
| Protease | 0.02 | 0.02 | 0.02 | 0.02 | 0.02 |
| Amylase | 0.01 | 0.01 | 0.01 | 0.01 | 0.01 |
| Preservative | 0.06 | 0.06 | 0.06 | 0.06 | 0.06 |
| Calcium Chloride | 0.05 | 0.05 | 0.05 | 0.05 | 0.05 |
| Fragrance | 0.53 | 0.53 | 0.53 | 0.53 | 0.53 |
| Encapsulated Fragrance | 0.0 (1)<br>0.05 (2) | 0.00 | 0.05 | 0.10 | 0.15 |
| Dye | 0.015 | 0.015 | 0.015 | 0.015 | 0.015 |
| Opacifier | 0.100 | 0.100 | 0.100 | 0.100 | 0.100 |

Linear Alkylbenzene Sulfonate is 2-Phenyl Sulfonic Acid.

C12-C15 Alcohol Ethoxylate-7 E/O is a C12-C15 Alcohol Ethoxylate that is capped with approximately 7 moles of ethylene oxide.

Amphoteric Surfactant is a betaine commercially available as Amphosol CG-50.

Smectite clay is hectorite that is commercially available under the tradename of Bentone EW.

F-dye is Tinopal 5BM-GX.

Encapsulated Fragrance is commercially available under the tradename of Summer Flower Popscent 247493 PMHN2911.

Suspension Control

To determine suspension control, multiple versions of Inventive Composition 1 are formed and evaluated.

First Version

A first version of Inventive Composition 1 is formed using the following method:

The smectite clay is added to a vessel containing only water and allowed to mix at the highest practical speed for 10 minutes. After sufficient hydration time, the following components are added in the following order: linear alkylbenzene sulfonate, citric acid, sodium hydroxide, triethanolamine, coconut oil fatty acid, calcium chloride, C12-C15 Alcohol Ethoxylate-7 E/O, sodium laureth sulfate, the betaine, and then all other components.

The method used to form this first version can be considered as a prior art method.

Second Version

A second version of Inventive Composition 1 is formed using a different method, as follows:

Using a propeller mixer at low to moderate speed (i.e., enough to form a small vortex), the smectite clay is added directly to the water in a vessel and allowed to mix for 30 minutes, or until the mixture is clear and the smectite clay is fully incorporated.

The vessel is then transferred to a homogenizer and allowed to pass through for a time period of 5 minutes. The homogenizer is set to a speed of 3500 rpm and applies shear to the mixture. There is no air entrapment as the mixture remains fluid and not gelled.

Subsequently, the following components are added in the following order: linear alkylbenzene sulfonate, citric acid, sodium hydroxide, triethanolamine, coconut oil fatty acid, calcium chloride, C12-C15 Alcohol Ethoxylate-7 E/O, sodium laureth sulfate, the betaine, and then all other components.

As the surfactants are added, the viscosity of the combination of components begins to increase and the structured composition begins to form. This change allows for greater ease of incorporation of those materials and reduced mixing times. This method allows for producing a stable, internally structured system.

The method used to form this first version can be considered as an inventive method.

Evaluation of First and Second Versions to Determine Suspension Control

After formation, a 4 oz sample of the first version is allowed to stand at room temperature overnight and then observed to determine if separation of the smectite clay from the water occurred.

A 4 oz sample of the second version is also allowed to stand at room temperature overnight and then observed to determine if separation of the smectite clay from the water occurred.

A 4 oz sample of the second version of Inventive Composition 1 is also stored for one month at 125° F. to simulate one year of shelf-life. This sample is also observed to determine if separation of the smectite clay from the water occurred. The results of these observations are forth in FIGS. 1-3.

FIG. 1 is a photograph of the first version of Inventive Composition 1 after standing at room temperature overnight. This sample exhibits product separation and visible particles of smectite clay disposed throughout the sample. This is due to use of a prior art method of forming the composition.

Figure 2:
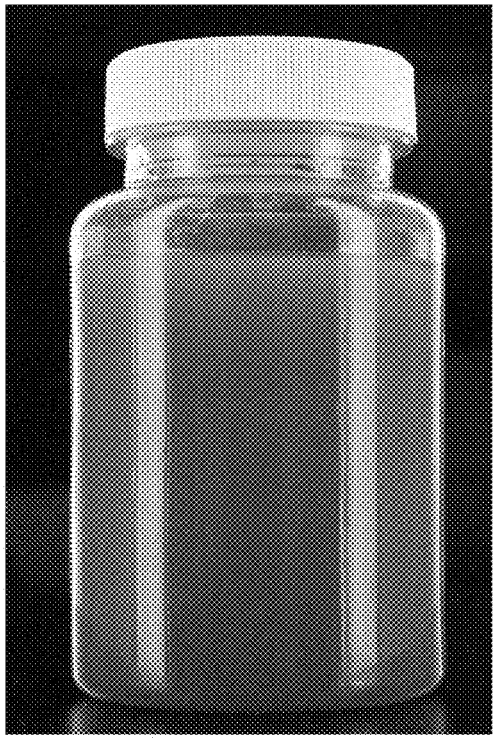
FIG. 2 is a photograph of a sample of a second version of Inventive Composition 1 after standing at room temperature overnight. This sample exhibits no visible product separation and instead exhibits uniform dispersion of the smectite clay. This is due to use of an inventive method of forming the composition.

FIG. 2 is a photograph of the second version of Inventive Composition 1 after standing at room temperature overnight. This sample exhibits no visible product separation and instead exhibits uniform dispersion of the smectite clay. This is due to use of an inventive method of forming the composition.

Figure 3:
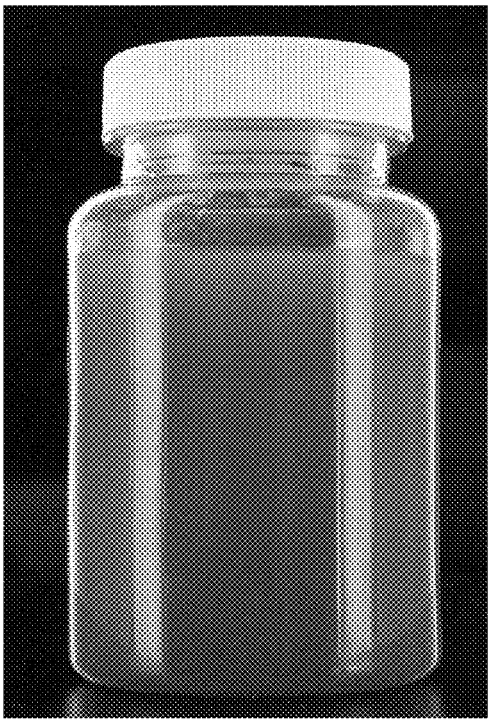
FIG. 3 is a photograph of a sample of the second version of Inventive Composition 1 after storage at about 125° F. for one month. This sample still exhibits no visible product separation and instead exhibits uniform dispersion of the smectite clay. Again, this is due to use of an inventive method of forming the composition.

FIG. 3 is a photograph of the second version of Inventive Composition 1 after storage at about 125° F. for one month. This sample still exhibits no visible product separation and instead exhibits uniform dispersion of the smectite clay. Again, this is due to use of an inventive method of forming the composition.

In additional experiments, third, fourth, fifth, sixth, and seventh versions of Inventive Composition 1 are also formed. Each of these versions are different from one another and from the first and second versions described above based on differing orders of addition of the acid, base, and buffer.

Third Version

In a third version, the base (NaOH) is added before the acid (citric acid) and before the buffer (triethanolamine) such that the order of addition is base, acid, buffer. This produced a product that was unstable, flocculated, and unusable. This is not shown in the Figures.

Fourth Version

In a fourth version, the acid (citric acid) is added first, followed by the buffer (triethanolamine), and then the base (NaOH) such that the order of addition is acid, buffer, base. This also produced a product that was unstable, flocculated, and unusable. This is not shown in the Figures.

Fifth Version

In a fifth version, the base (NaOH) is added first, followed by the buffer (triethanolamine), and then the acid (citric acid) such that the order of addition is base, buffer, acid. This also produced a product that was unstable, flocculated, and unusable. This is not shown in the Figures.

Sixth Version

In a sixth version, the buffer (triethanolamine) is added first, followed by the base (NaOH), and then the acid (citric acid) such that the order of addition is buffer, base, acid. This also produced a product that was unstable, flocculated, and unusable. This is not shown in the Figures.

Seventh Version

In a seventh version, the buffer (triethanolamine) is added first, followed by the acid (citric acid), and then the base (NaOH) such that the order of addition is buffer, acid, base. This also produced a product that was unstable, flocculated, and unusable. This is not shown in the Figures.

Superior and Unexpected Results

As is demonstrated by the aforementioned results, the inventive method used to form the second version of Inventive Composition 1 produced special and unexpected results that are superior to those achieved by the method used to form the first version of Inventive Composition 1. Namely, the method used to form the second version of Inventive Composition 1 which utilizes the homogenizer and applies shear to the mixture forms a superior product to the method that does not utilize the homogenizer.

Moreover, the inventive method that utilizes the specific order of addition of surfactant followed by acid, followed by base, followed by buffer, to form the second version of Inventive Composition 1 is superior to the other options used to form the third through seventh versions of Inventive Composition 1. These results are also summarized in Table 2 below.

TABLE 2

| | First Version | Second Version | Third Version | Fourth Version | Fifth Version | Sixth Version | Seventh Version |
|---|---|---|---|---|---|---|---|
| Use of Homogenizer/ Shear | No | Yes | Yes | Yes | Yes | Yes | Yes |

TABLE 2-continued

| | First Version | Second Version | Third Version | Fourth Version | Fifth Version | Sixth Version | Seventh Version |
|---|---|---|---|---|---|---|---|
| Order of Addition: (1) Acid, (2) Base, (3) Buffer | Yes | Yes | No | No | No | No | No |
| Order of Addition: (1) Base, (2) Acid, (3) Buffer | No | No | Yes | No | No | No | No |
| Order of Addition: (1) Acid, (2) Buffer, (3) Base | No | No | No | Yes | No | No | No |
| Order of Addition: (1) Base, (2) Buffer, (3) Acid | No | No | No | No | Yes | No | No |
| Order of Addition: (1) Buffer, (2) Acid, (3) Base | No | No | No | No | No | Yes | No |
| Order of Addition: (1) Buffer, (2) Base, (3) Acid | No | No | No | No | No | No | Yes |
| Stable Product Formed | No | Yes | No | No | No | No | No |

The designation stable refers to a sample that did not demonstration separation of the smectite clay or flocculation. The designation unstable refers to a sample that exhibited separation and/or flocculation of the smectite clay from the water.

Yield Stress/Rheology

Samples of the first and second version of Inventive Composition 1 are formed using the aforementioned methods.

Again, after formation, a 4 oz sample of the first version is allowed to stand at room temperature overnight.

A 4 oz sample of the second version is also allowed to stand at room temperature overnight.

A 4 oz sample of the second version of Inventive Composition 1 is also stored for one month at 125° F. to simulate one year of shelf-life.

Each of these three samples are then evaluated to determine whether they were structured via rheology measurements. More specifically, the rheology determinations are made using AR2000 rheometer from TA instruments using a 2 degree cone with a 52 um truncation at 25 C. The results are set forth in FIGS. 4-6.

FIG. 4 is an oscillatory yield stress graph of the first version of Inventive Composition 1 that shows that no yield stress point is observed thereby indicating that the composition is not structured. More specifically, this Figure shows that the points on the graph are scattered thereby indicating that there is no yield stress point.

FIG. 5 is an oscillatory yield stress graph of the second version of Inventive Composition 1 that is allowed to stand at room temperature overnight. This graph shows that an yield stress point is observed thereby indicating that the composition is structured. More specifically, the yield stress point is observed at about 2.168 Pa and a G' of about 1.202 Pa.

FIG. 6 is an oscillatory yield stress graph of the second version of Inventive Composition 1 that is stored for one month at 125° F. Measurements are taken at the top, middle, and bottom of the sample, as determined visually. This graph shows that an yield stress point is observed in all of the top, middle, and bottom, thereby indicating that the composition is structured. More specifically, the yield stress point is observed at the top at about 3.527 Pa and a G' of about 0.6458 Pa. The yield stress point is observed at the middle at about 3.748 Pa and a G' of about 0.7913 Pa. The yield stress point is observed at the bottom at about 4.187 Pa and a G' of about 0.7288 Pa.

Accordingly, the use of the inventive method allows the Composition to be structured. This is important because it allows for better and more efficient delivery of active agents and because the structuring allows for uniform suspension of compounds in the compositions so that the compounds do not sink to the bottom of the container.

Particle Distribution

Samples of the Comparative Composition 1 and samples of the Inventive Composition 2, 3, and 4 are also evaluated to determine particle distribution.

Comparative Composition 1 was formed by combining all of the compounds together in no particular order.

Samples of the Inventive Composition 2, 3, and 4 are formed using the same method described above that was used to form the second version of the Inventive Composition 1, i.e., using the homogenizer and the order of addition of acid, base, and buffer. Each of these samples was aged at 125° F. for about one month.

As set forth above, the Comparative Composition 1 includes no smectite and no encapsulated fragrance. Inventive Composition 2 includes 0.05 wt % actives of the encapsulated fragrance. The Inventive Composition 3 includes 0.10 wt % actives of the encapsulated fragrance. The Inventive Composition 4 includes 0.15 wt % actives of the encapsulated fragrance.

These samples are evaluated using a fiber optic particle size analyzer which determines distribution of particles between a top, middle, and bottom of a sample. The particle sizes of interest are those <10 microns, 10-50 micros, and 50-100 microns. More specifically, the particle distribution determinations are made using an FBRM G400 from Mettler Toledo. The method employed is as follows: (1) Make the detergent batch; (2) Split the batch into bottles with a minimum sample size of 150 g, one bottle per pull per condition. (e.g. 1 week and 2 weeks pulls at 125° F. require 2 bottles); and (3) Let the batch rest overnight before analyzing placing in desired storage conditions. Samples are then removed from the stability chambers and equilibrated in the 70° F. oven, ideally overnight. Then, 45 g is poured into separate 50 ml beakers, dividing the sample into top, middle, and bottom layers. A cross bar magnetic stirrer (no larger than 1 inch) is then placed in the beaker with the detergent. The beaker is placed on a stirring plate and increase speed until it creates a vortex with no splashing of the sample. Speed is kept consistent across all samples and pull points. An FBRM probe is then placed at a 45° angle and data is recorded for 2 min after the counts are stable. This repeated with all samples. The results are set forth in FIG. 7.

Figure 7:
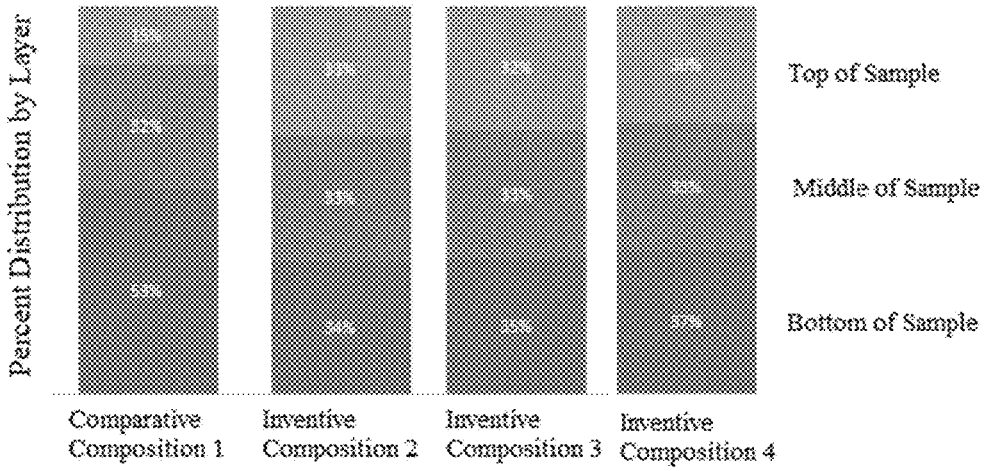
FIG. 7 is a bar graph of the results of a particle distribution analysis that shows that the Inventive Compositions 2, 3, and 4 each exhibit a more equal distribution of particles throughout the top, middle, and bottom of the samples as compared to Comparative Composition 1 which includes a much higher percentage of particles at the bottom of the sample.

FIG. 7 is a bar graph of the results of the particle distribution that shows that the Inventive Compositions 2, 3, and 4 each exhibit a more equal distribution of particles throughout the top, middle, and bottom of the samples as compared to Comparative Composition 1 which includes a much higher percentage of particles at the bottom of the sample. This is indicative of an unstable sample that includes settling of the smectite clay and separation from the water of the sample.

Accordingly, the inventive composition produces structured compositions that suspend components approximately equally at various physical locations of the same (e.g. the top, middle, and bottom). Moreover, the structuring is stable even at high heat exposure for long periods of time.

Optical Brightness

A sample of the Comparative Composition 1 and a sample of the Inventive Composition 3 are also evaluated to determine their effects on optical brightness when used to treat/wash a textile. The Comparative Composition 1 includes no smectite and no encapsulated fragrance. Inventive Composition 3 includes 0.10 wt % actives of the encapsulated fragrance.

These samples are evaluated using a Konica Minolta CM3600A. The results are set forth in FIGS. 8 and 9A-9C.

Figure 8:
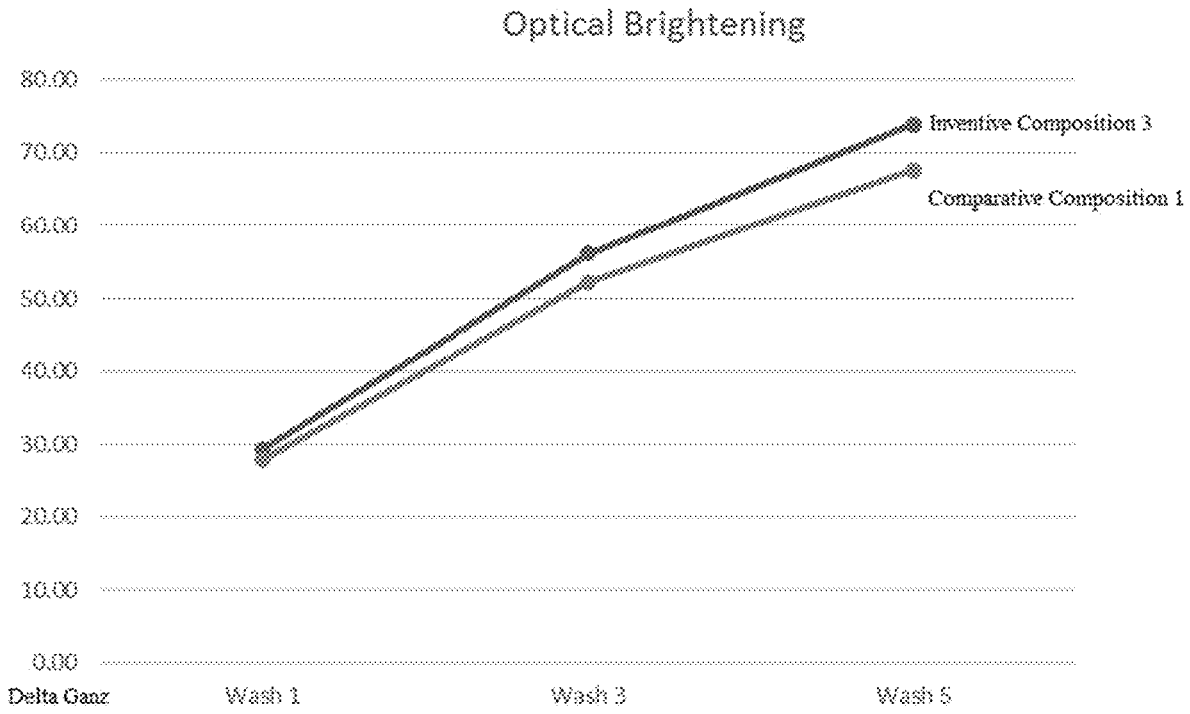
FIG. 8 is a line graph showing optical brightening of the Comparative Composition 1 and the Inventive Composition 3 over 1, 3, and 5 washes, wherein Inventive Composition 3 outperforms the Comparative Composition 1.

FIG. 8 is a line graph showing optical brightening of the Comparative Composition 1 and the Inventive Composition 3 over 1, 3, and 5 washes. This line graph clearly shows that the Inventive Composition 3 outperforms the Comparative Composition 1.

These results are also statistically evaluated to determine significance of the difference as set forth in Table 3 below.

TABLE 3

LSMeans Differences Tukey HSD
$\alpha = 0.050$; Q = 3.20234

| Wash 1 | A/B; Significance | Least Sq Mean |
|---|---|---|
| Inventive Composition 3 | A | 29.346667 |
| Comparative Composition 1 | A | 27.820000 |
| Statistically Significant Difference | No | No |
| **Wash 3** | **A/B** | **Least Sq Mean** |
| Inventive Composition 3 | A | 56.133333 |
| Comparative Composition 1 | B | 52.270000 |
| Statistically Significant Difference | Yes | Yes |
| **Wash 5** | **A/B** | **Least Sq Mean** |
| Inventive Composition 3 | A | 73.900000 |
| Comparative Composition 1 | B | 67.593333 |
| Statistically Significant Difference | Yes | Yes |

This data shows that the Inventive Composition 3 outperforms the Comparative Composition 1 at a statistically significant level after 3 and 5 washes.

Figure 9A:
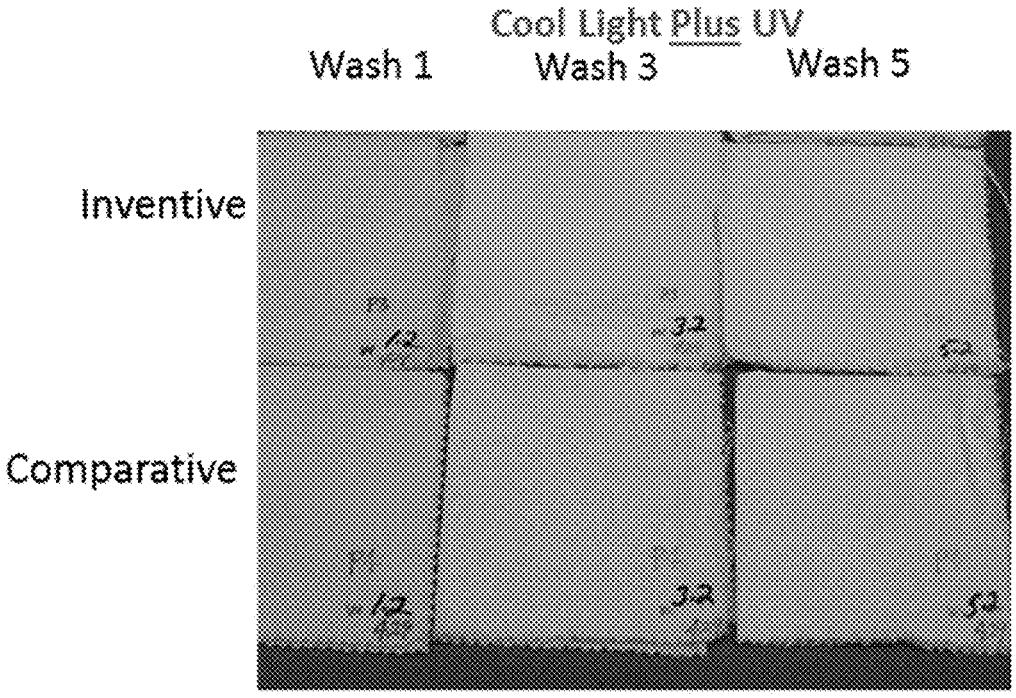
FIG. 9A is a photograph of various textile samples of the Examples exhibiting optical brightening under a Cool Light (i.e., about 4200K) plus UV light (i.e., from about 350 to about 700 nm).

Moreover, relative to the Figures, FIG. 9A is a photograph of various textile samples of the Examples exhibiting optical brightening under a Cool Light (about 4200K) plus UV light (having a wavelength of about 350 to about 700 nm).

Figure 9B:
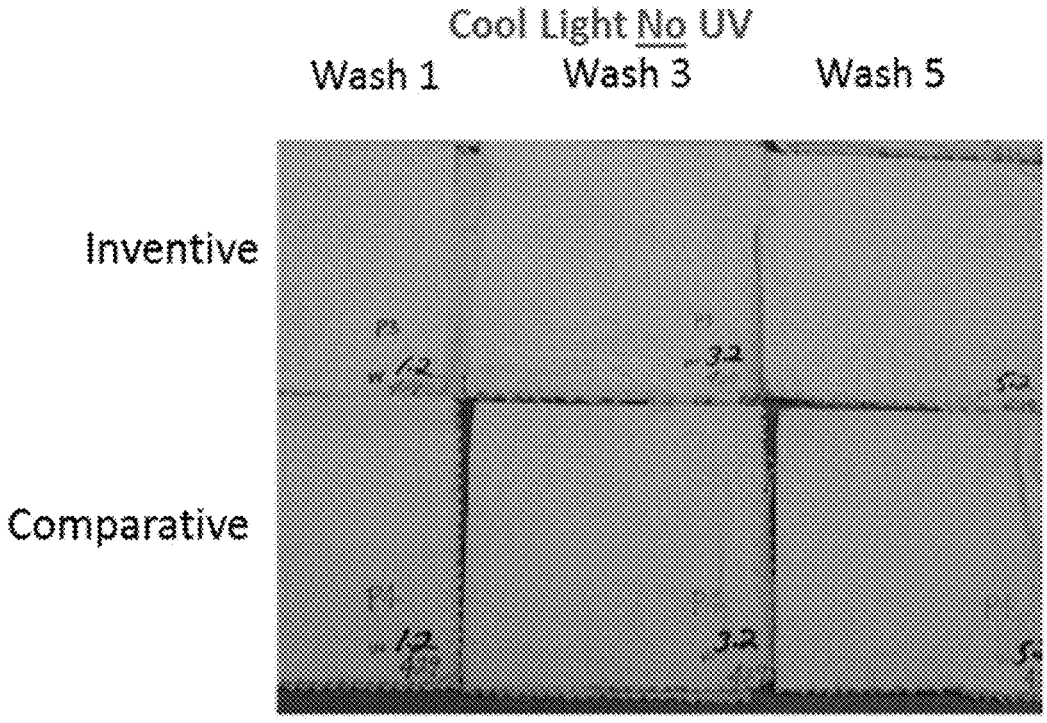
FIG. 9B is a photograph of various textile samples of the Examples exhibiting optical brightening under a Cool Light (i.e., about 4200K) without UV light.

FIG. 9B is a photograph of various textile samples of the Examples exhibiting optical brightening under a Cool Light (about 4200K) without UV light.

Figure 9C:
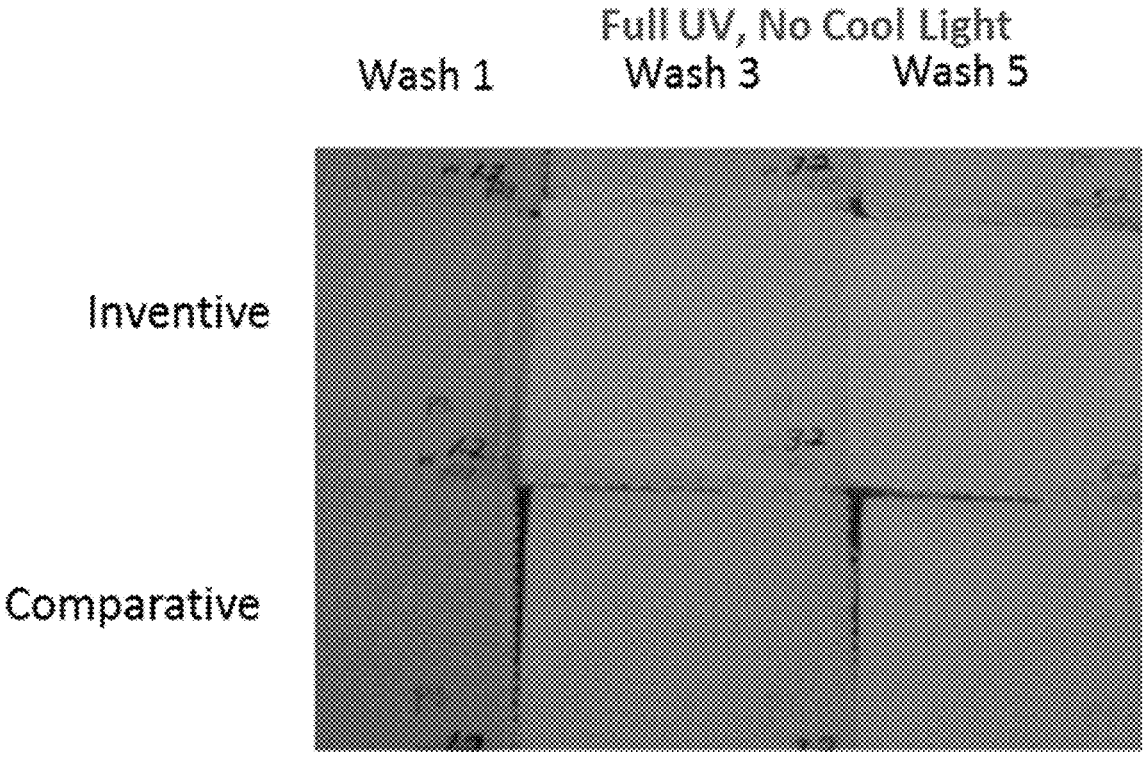
FIG. 9C is a photograph of various textile samples of the Examples exhibiting optical brightening under a UV light (i.e., from about 350 to about 700 nm) without Cool Light.

FIG. 9C is a photograph of various textile samples of the Examples exhibiting optical brightening under a UV light (having a wavelength of about 350 to about 700 nm) without Cool Light.

These Figures show that, via visual determination, the textiles washed with the Inventive Composition 3 exhibit superior optical brightness. This is visually observed with the naked eye and increased whiteness.

Figure 10:
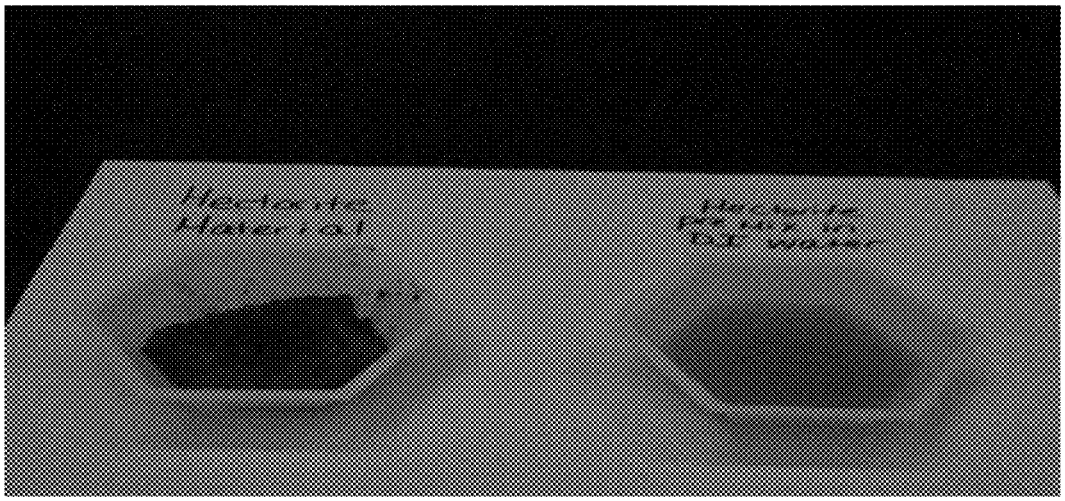
FIG. 10 is a photograph of smectite clay alone (non-hydrated) and hydrated under UV light which shows that the smectite clay does not fluoresce and demonstrates that the optical brightening achieved by the Examples is not due to inherent fluorescence of the smectite clay and is, instead, surprising and unexpected.

In addition, FIG. 10 is a photograph of smectite clay alone (non-hydrated) and hydrated under UV light which shows that the smectite clay does not fluoresce. This is important because it demonstrates that the optical brightening is not due to inherent fluorescence of the smectite clay and is, instead, surprising and unexpected.

Whitening Maintenance

A sample of the Comparative Composition 1 and a sample of the Inventive Composition 3 are also evaluated to determine their effects on whitening maintenance, also known as anti-redeposition, when used to treat/wash a textile. The Comparative Composition 1 includes no smectite and no encapsulated fragrance. Inventive Composition 3 includes 0.10 wt % actives of the encapsulated fragrance.

These samples are evaluated using a Konica Minolta CM3600A, Xrite Ci7860, or a Hunter Ultrascan Pro.

The results are set forth in FIGS. 11 and 12A-12C.

Figure 11:
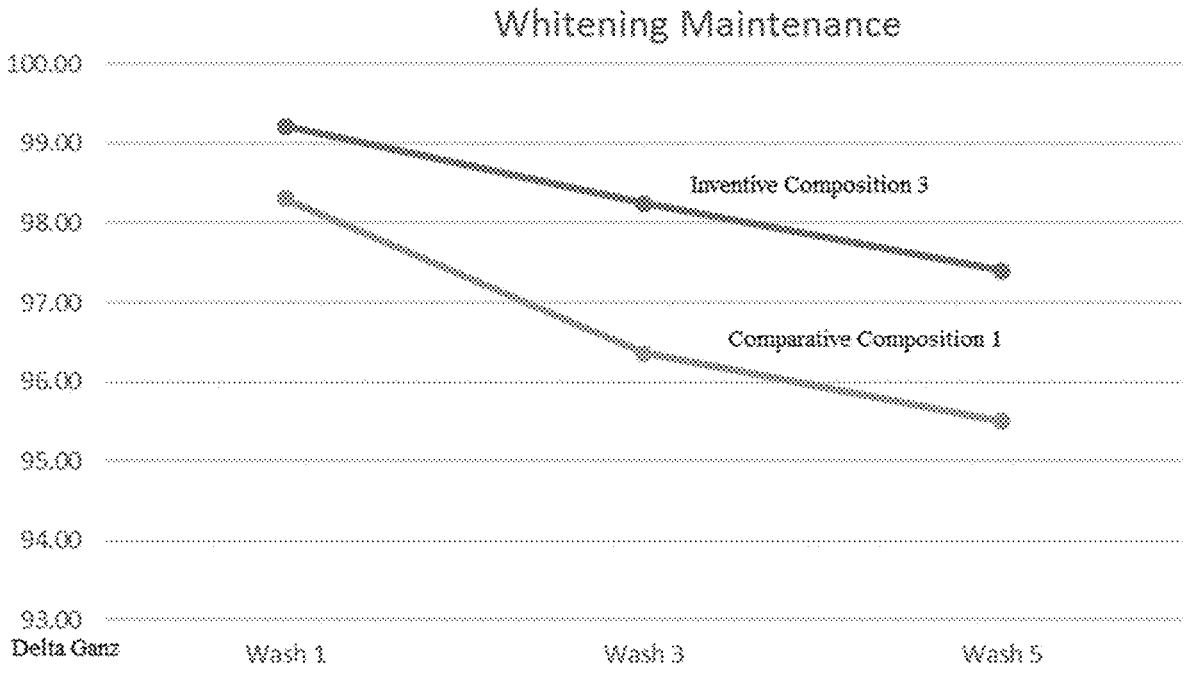
FIG. 11 is a line graph showing whitening maintenance of the Comparative Composition 1 and the Inventive Composition 3 over 1, 3, and 5 washes which evidences that the Inventive Composition 3 outperforms the Comparative Composition 1.

FIG. 11 is a line graph showing whitening maintenance of the Comparative Composition 1 and the Inventive Composition 3 over 1, 3, and 5 washes. This line graph clearly shows that the Inventive Composition 3 outperforms the Comparative Composition 1.

These results are also statistically evaluated to determine significance of the difference as set forth in Table 4 below.

TABLE 4

| LSMeans Differences Tukey HSD $\alpha = 0.050$; Q = 3.20234 | | |
|---|---|---|
| Wash 1 | A/B; Significance | Least Sq Mean |
| Inventive Composition 3 | A | 99.220000 |
| Comparative Composition 1 | B | 98.306667 |
| Statistically Significant Difference | Yes | Yes |
| Wash 3 | A/B | Least Sq Mean |
| Inventive Composition 3 | A | 98.246667 |
| Comparative Composition 1 | B | 96.356667 |
| Statistically Significant Difference | Yes | Yes |
| Wash 5 | A/B | Least Sq Mean |
| Inventive Composition 3 | A | 97.400000 |
| Comparative Composition 1 | B | 95.583333 |
| Statistically Significant Difference | Yes | Yes |

This data shows that the Inventive Composition 3 outperforms the Comparative Composition 1 at a statistically significant level after 1, 3 and 5 washes.

Figure 12A:
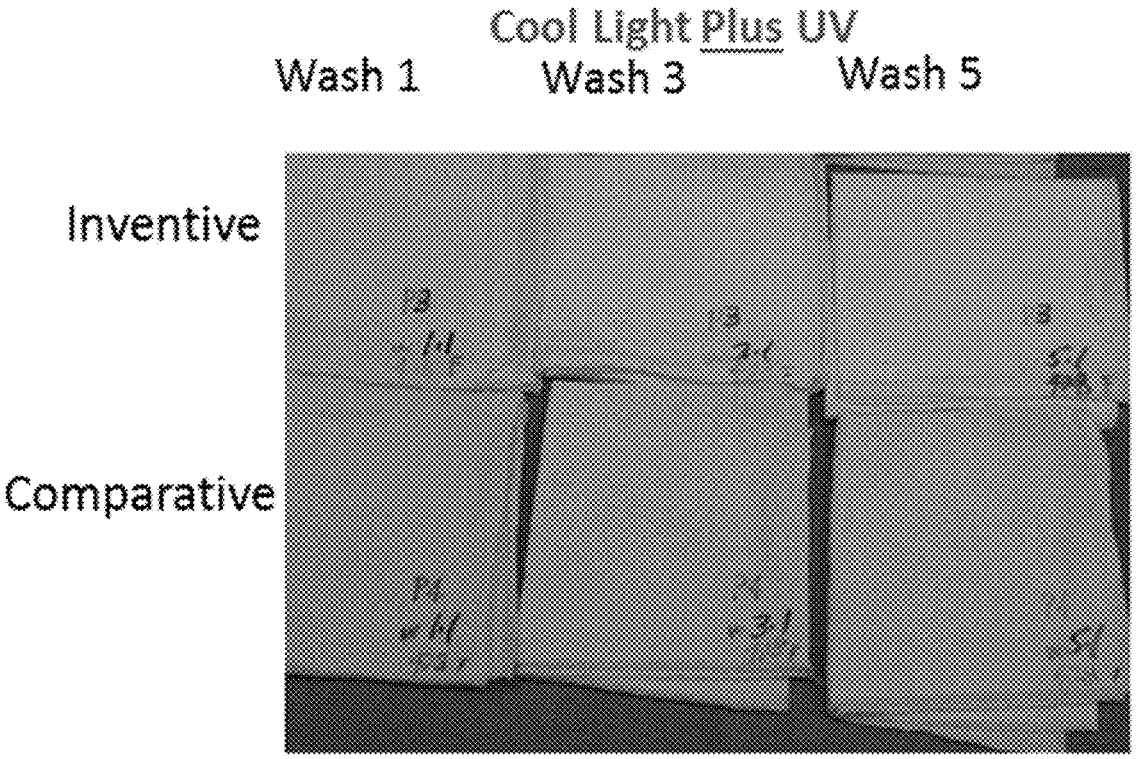
FIG. 12A is a photograph of various textile samples of the Examples exhibiting whitening maintenance under a Cool Light plus UV light.

FIG. 12A is a photograph of various textile samples of the Examples exhibiting whitening maintenance under a Cool Light (about 4200K) plus UV light.

Figure 12B:
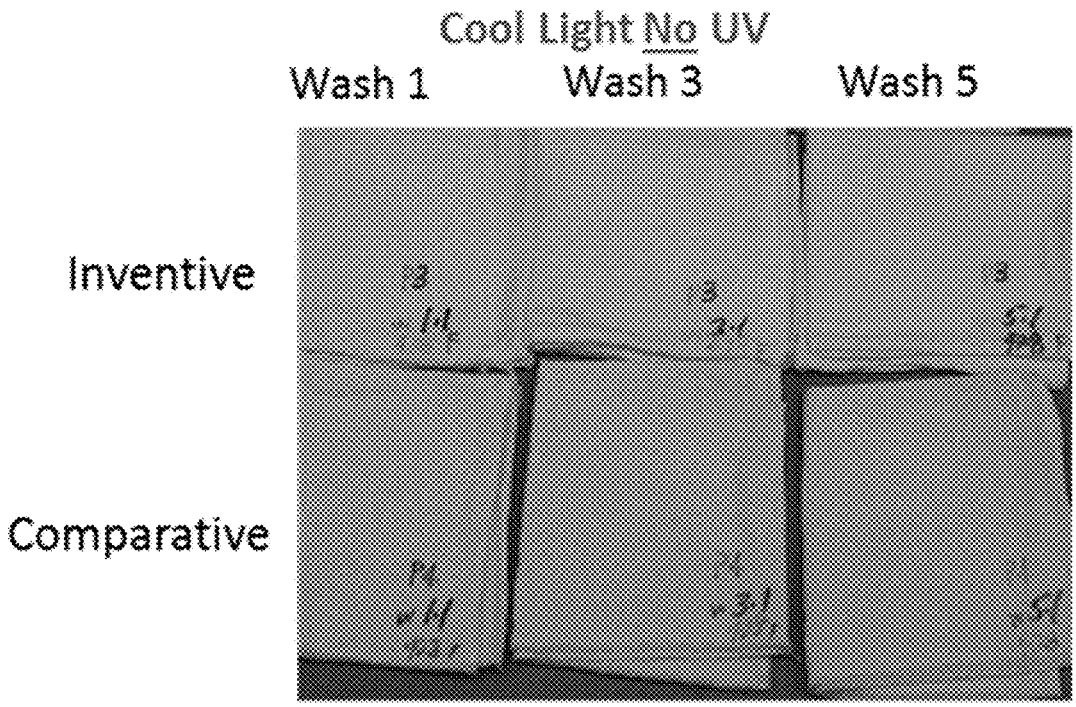
FIG. 12B is a photograph of various textile samples of the Examples exhibiting whitening maintenance under a Cool Light without UV light.
Figure 12C:
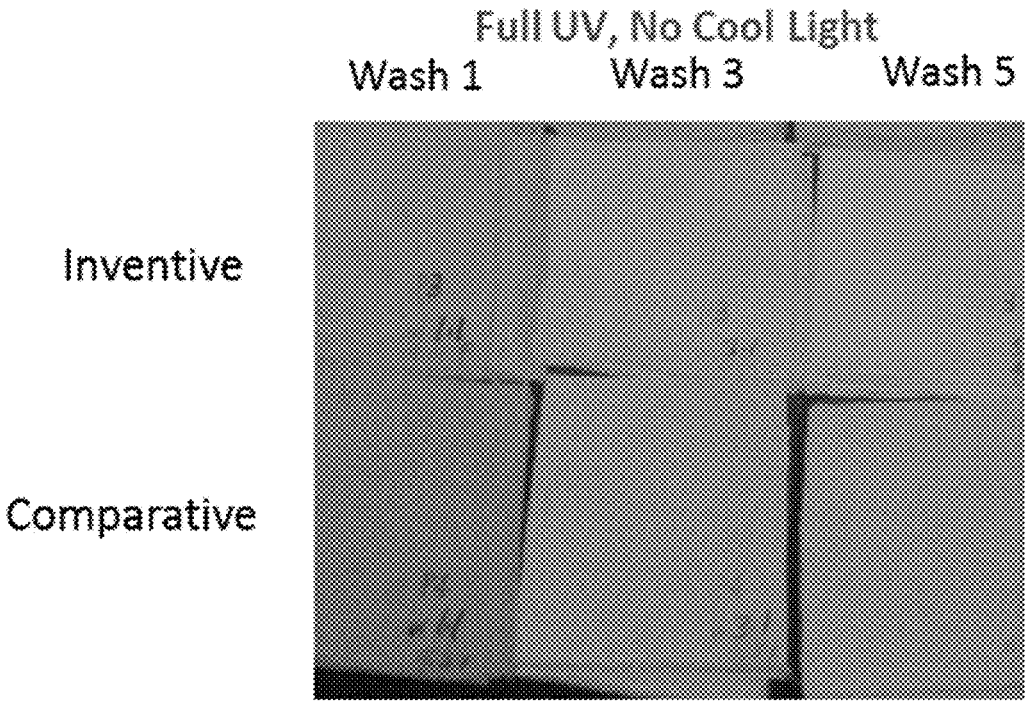
FIG. 12C is a photograph of various textile samples of the Examples exhibiting whitening maintenance under a UV light without Cool Light.

FIG. 12B is a photograph of various textile samples of the Examples exhibiting whitening maintenance under a Cool Light (about 4200K) without UV FIG. 12C is a photograph of various textile samples of the Examples exhibiting whitening maintenance under a UV light (having a wavelength of about 350 to about 700 nm) without Cool Light.

These Figures show that, via visual determination, the textiles washed with the Inventive Composition 3 exhibit superior whitening maintenance. This is visually observed with the naked eye and increased whiteness.

Stain Removal Performance

In addition to the above, experimentation shows that the smectite clay provides all of the aforementioned superior and unexpected enhancements without a negative effect on stain removal performance. More specifically, Comparative Composition 1 and Inventive Composition 3 are tested using standard stain tests known in the industry at both 90° F. and 59° F. according to ASTM D4265. The results are set forth in Tables 5 and 6 below.

TABLE 5

| Stain - 90° F. | Fabric | Comparison of Comparative and Inventive |
|---|---|---|
| Blood | Knitted Cotton | Statistically Significant Parity |
| Blood | Woven Blend | Statistically Significant Improvement with Inventive |
| Chocolate Ice Cream | Knitted Cotton | Statistically Significant Parity |
| Chocolate Ice Cream | Woven Blend | Statistically Significant Parity |
| Coffee | Knitted Cotton | Statistically Significant Parity |
| Coffee | Woven Blend | Statistically Significant Parity |
| Dust Sebum | Knitted Cotton | Statistically Significant Parity |
| Dust Sebum | Woven Blend | Statistically Significant Parity |
| Grape Juice | Knitted Cotton | Statistically Significant Parity |
| Grape Juice | Woven Blend | Statistically Significant Parity |
| Grass | Knitted Cotton | Statistically Significant Parity |
| Grass | Woven Blend | Statistically Significant Parity |
| BBQ Sauce | Knitted Cotton | Statistically Significant Improvement with Inventive |

TABLE 5-continued

| Stain - 90° F. | Fabric | Comparison of Comparative and Inventive |
|---|---|---|
| BBQ Sauce | Woven Blend | Statistically Significant Parity |
| Mud | Knitted Cotton | Statistically Significant Parity |
| Mud | Woven Blend | Statistically Significant Parity |

Relative to Table 5, $\alpha = 0.05$.

TABLE 6

| Stain - 59° F. | Fabric | Comparison of Comparative and Inventive |
|---|---|---|
| Blood | Knitted Cotton | Inventive Trending Negative But Not Statistically Significant |
| Blood | Woven Blend | Inventive Trending Negative But Not Statistically Significant |
| Chocolate Ice Cream | Knitted Cotton | Statistically Significant Parity |
| Chocolate Ice Cream | Woven Blend | Statistically Significant Parity |
| Coffee | Knitted Cotton | Inventive Trending Negative But Not Statistically Significant |
| Coffee | Woven Blend | Statistically Significant Parity |
| Dust Sebum | Knitted Cotton | Statistically Significant Parity |
| Dust Sebum | Woven | Blend Statistically Significant Parity |
| Grape Juice | Knitted Cotton | Statistically Significant Parity |
| Grape Juice | Woven Blend | Statistically Significant Parity |
| Grass | Knitted Cotton | Inventive Trending Negative But Not Statistically Significant |
| Grass | Woven | Blend Statistically Significant Parity |
| BBQ Sauce | Knitted Cotton | Statistically Significant Parity |
| BBQ Sauce | Woven Blend | Statistically Significant Parity |
| Mud | Knitted Cotton | Statistically Significant Parity |
| Mud | Woven Blend | Statistically Significant Parity |

Relative to Table 6, $\alpha = 0.05$.

The data set forth above shows that there were no instances wherein the Inventive Composition performed negatively as compared to the Comparative Composition, to a level of statistical significance. In most cases, the cleaning performance was the same. However, as shown in Table 5, there are a few instances wherein cleaning performance actually improved to a statistically significant degree.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A structured detergent composition that has a yield stress point, said structured detergent composition comprising:

A. a surfactant component present in an amount of from about 10 to about 20 weight percent actives based on a total weight of said composition;

B. water present in a total amount of from about 40 to about 90 weight percent based on a total weight of said composition;

hectorite clay present in an amount of from about 0.2 to about 0.5 weight percent actives based on a total weight of said composition;

C. an acid;

D. a base; and

E. a buffer, wherein said structured detergent composition is free of separation of said hectorite clay from said water and is free of flocculation.

2. The structured detergent composition of claim 1 further comprising at least one active agent suspended in said structured detergent composition and present in an amount of greater than zero and up to about 5 weight percent actives based on a total weight of said composition.

3. The structured detergent composition of claim 2 wherein at least one active agent is encapsulated and suspended in said structured detergent composition wherein said encapsulated active agent is present in an amount of greater than zero and up to about 1 weight percent actives based on a total weight of said composition.

4. The structured detergent composition of claim 3 wherein said encapsulated active agent is a skin care ingredient.

5. The structured detergent composition of claim 3 wherein said encapsulated active agent is a fragrance.

6. The structured detergent composition of claim 3 further comprising an additional active agent that is not encapsulated.

7. The structured detergent composition of claim 5 wherein said surfactant component is present in an amount of about 10 to about 15 weight percent actives based on a total weight of said composition and comprises:

an alcohol ethoxy sulfate having a $C_8$-$C_{20}$ backbone that is ethoxylated with from about 1 to about 10 moles of ethylene oxide;

a linear alkylbenzene sulfonate; and an ethoxylated alcohol comprising a $C_8$-$C_{20}$ backbone that is ethoxylated with from about 2 to about 12 moles of ethylene oxide.

8. The structured detergent composition of claim 7 that is free of an external structuring agent chosen from electrolytes, microgel particles, acrylate polymers, structuring gums, starch, agar, hydroxyl alkyl cellulose, fibrous polymers, hydrous aluminum phyllosilicates, parenchymal cellulose materials, or particulate cellulose materials.

9. The structured detergent composition of claim 1 that is free of an external structuring agent chosen from electrolytes, microgel particles, acrylate polymers, structuring gums, starch, agar, hydroxyl alkyl cellulose, fibrous polymers, hydrous aluminum phyllosilicates, parenchymal cellulose materials, or particulate cellulose materials.

10. The structured detergent composition of claim 1 wherein said surfactant component comprises:

an alcohol ethoxy sulfate having a $C_8$-$C_{20}$ backbone that is ethoxylated with from about 1 to about 10 moles of ethylene oxide and is present in an amount of from about 3 to about 5 weight percent actives based on a total weight of said composition;

a linear alkylbenzene sulfonate present in an amount of from about 1 to about 2 weight percent actives based on a total weight of said composition; and an ethoxylated alcohol comprising a $C_8$-$C_{20}$ backbone that is ethoxylated with from about 2 to about 12 moles of ethylene oxide present in an amount of from about 6 to about 8 weight percent actives based on a total weight of said composition.

11. The structured detergent composition of claim 10 that is free of an external structuring agent chosen from electrolytes, microgel particles, acrylate polymers, structuring gums, starch, agar, hydroxyl alkyl cellulose, fibrous polymers, hydrous aluminum phyllosilicates, parenchymal cellulose materials, or particulate cellulose materials.

12. The structured detergent composition of claim 1 consisting of:

a linear alkyl benzene sulfonate;

sodium laureth sulfate;

a $C_{12}$-$C_{15}$ alcohol ethoxylate that is capped with approximately 7 moles of ethylene oxide;

coconut oil fatty acid;

an amphoteric surfactant;

triethanolamine;

sodium hydroxide;

citric acid;

hectorite clay;

a chelator;

a dye;

an anti-redeposition agent;

a protease;

an amylase;

a preservative;

calcium chloride;

a fragrance;

an optional encapsulated fragrance;

a dye;

an opacifier, and water.

13. The structured detergent composition of claim 12, wherein said linear alkyl benzene sulfonate is present in an amount of about 1.8 wt. % actives;

said sodium laureth sulfate is present in an amount of about 4 wt. % actives;

said $C_{12}$-$C_{15}$ alcohol ethoxylate is present in an amount of about 6.8 wt. % actives;

said coconut oil fatty acid is present in an amount of about 0.5 wt. % actives;

said amphoteric surfactant is present in an amount of about 0.8 wt. % actives;

said triethanolamine is present in an amount of about 0.6 wt. % actives;

said sodium hydroxide is present in an amount of about 1.6 wt. % actives;

said citric acid is present in an amount of about 2.3 wt. % actives;

said hectorite clay is present in an amount of about 0.3 wt. % actives;

said chelator is present in an amount of about 0.3 wt. % actives;

said dye is present in an amount of about 0.1 wt. % actives;

said anti-redeposition agent is present in an amount of about 0.1 wt. % actives;

said protease is present in an amount of about 0.02 wt. % actives;

said amylase is present in an amount of about 0.01 wt. % actives;

said preservative is present in an amount of about 0.06 wt. % actives;

said calcium chloride is present in an amount of about 0.1 wt. % actives;

said fragrance is present in an amount of about 0.5 wt. % actives;

said optional encapsulated fragrance that when present is present in an amount of greater than zero and up to about 0.2 wt. % actives;

said dye is present in an amount of about 0.02 wt. % actives;

said opacifier is present in an amount of about 0.1 wt. % actives; and said water is present in a balance such that a total weight of said structured detergent composition is 100 wt %.

14. The structured detergent composition of claim 1 wherein said surfactant component is present in an amount of about 10 to about 15 weight percent actives based on a total weight of said composition and comprises:

an alcohol ethoxy sulfate having a $C_8$-$C_{20}$ backbone that is ethoxylated with from about 1 to about 10 moles of ethylene oxide;

a linear alkylbenzene sulfonate; and an ethoxylated alcohol comprising a $C_8$-$C_{20}$ backbone that is ethoxylated with from about 2 to about 12 moles of ethylene oxide.

15. The structured detergent composition of claim 1 wherein said surfactant component is present in an amount of about 10 to about 15 weight percent actives based on a total weight of said composition.

16. A structured detergent composition that has a yield stress point, said structured detergent composition comprising:

A. a surfactant component present in an amount of about 14 weight percent actives based on a total weight of said composition;

B. water present in a total amount of about 80 weight percent based on a total weight of said composition;

C. hectorite clay present in an amount of about 0.3 weight percent actives based on a total weight of said composition;

D. an organic acid present in an amount of about 2.25 weight percent actives based on a total weight of said composition;

E. a metal hydroxide present in an amount of about 1.6 weight percent actives based on a total weight of said composition; and F. a buffer present in an amount of about 0.6 weight percent actives based on a total weight of said composition, wherein said structured detergent composition is free of separation of said hectorite clay from said water and is free of flocculation.

17. The structured detergent composition of claim 16 wherein the organic acid is citric acid, the metal hydroxide is sodium hydroxide, and the buffer is triethanolamine.

18. The structured detergent composition of claim 17 wherein said surfactant component comprises:

an alcohol ethoxy sulfate having a $C_8$-$C_{20}$ backbone that is ethoxylated with from about 1 to about 10 moles of ethylene oxide;

a linear alkylbenzene sulfonate; and an ethoxylated alcohol comprising a $C_8$-$C_{20}$ backbone that is ethoxylated with from about 2 to about 12 moles of ethylene oxide.

* * * * *